United States Patent [19]

Holland

[11] Patent Number: 4,611,974

[45] Date of Patent: Sep. 16, 1986

[54] HYDRAULICALLY OPERATED WELL PUMP SYSTEM

[76] Inventor: John H. Holland, 2706 Walnut Rd., Norman, Okla. 73069

[21] Appl. No.: 615,300

[22] Filed: May 30, 1984

[51] Int. Cl.[4] ..... F04B 47/08

[52] U.S. Cl. ..... 417/388; 417/554

[58] Field of Search ..... 417/378, 383, 388, 392, 417/401, 546, 547, 554

[56] References Cited

U.S. PATENT DOCUMENTS

| | | | |
|---|---|---|---|
| 2,031,826 | 2/1936 | Ekstromer | 417/546 X |
| 2,180,366 | 11/1939 | Reichert | 417/378 |
| 2,429,947 | 10/1947 | Rose | 417/388 |
| 2,519,679 | 8/1950 | MacNeil . | |
| 2,555,613 | 6/1951 | Soberg | 417/388 |
| 3,096,717 | 7/1963 | Roeder | 417/388 X |
| 3,420,183 | 1/1969 | Hart . | |
| 3,941,510 | 3/1976 | Morgan | 417/57 |
| 3,941,511 | 3/1976 | Morgan | 417/57 |
| 4,013,385 | 3/1977 | Peterson | 417/378 X |
| 4,383,803 | 5/1983 | Reese | 417/259 |
| 4,405,291 | 9/1983 | Canalizo | 417/91 X |

OTHER PUBLICATIONS

Kobe, Inc. Bulletin No. FRP982 (R-783).
Kobe, Inc. 1980-1981 Composite Catalog (5M-12/80).
Kobe, Inc. Bulletin No. SU-675 (Rev. 4/78).

*Primary Examiner*—Leonard E. Smith
*Attorney, Agent, or Firm*—Hubbard, Thurman, Turner & Tucker

[57] ABSTRACT

A downhole well pump system comprises a reciprocating piston pump disposed in a fluid conduit in a wellbore which is filled with a driving fluid having a density preferably greater than the production fluid being pumped. The pump cylinder has a transverse partition and a piston assembly including an elongated piston rod extending through the partition and connected at its opposite ends to spaced apart pistons. The pump pistons and the cylinder partition divide the cylinder into a production fluid intake chamber, a production fluid transfer and delivery chamber, a driving fluid chamber and a second production fluid delivery chamber. Production fluid is conducted to the surface through a production fluid conduit disposed coaxial within the driving fluid conduit. A power transfer apparatus includes opposed cylinders and an opposed piston assembly interconnected by a common piston rod forming opposed production fluid and driving fluid chambers wherein the fluids are oscillated by the power transfer apparatus in the respective conduits and a net delivery of production fluid is conducted to a production fluid delivery line. Opposed hydraulic fluid chambers in the power transfer apparatus are connected to a reversible hydraulic pump. Pump driving fluid may be biased by an accumulator formed in the driving fluid conduit or in an accumulator cylinder connected to the pump in a modified version of the system which eliminates the driving fluid conduit. Embodiments of the pump system include mechanical rod actuated pumps which are operated on a lifting stroke by the column of production fluid.

30 Claims, 20 Drawing Figures

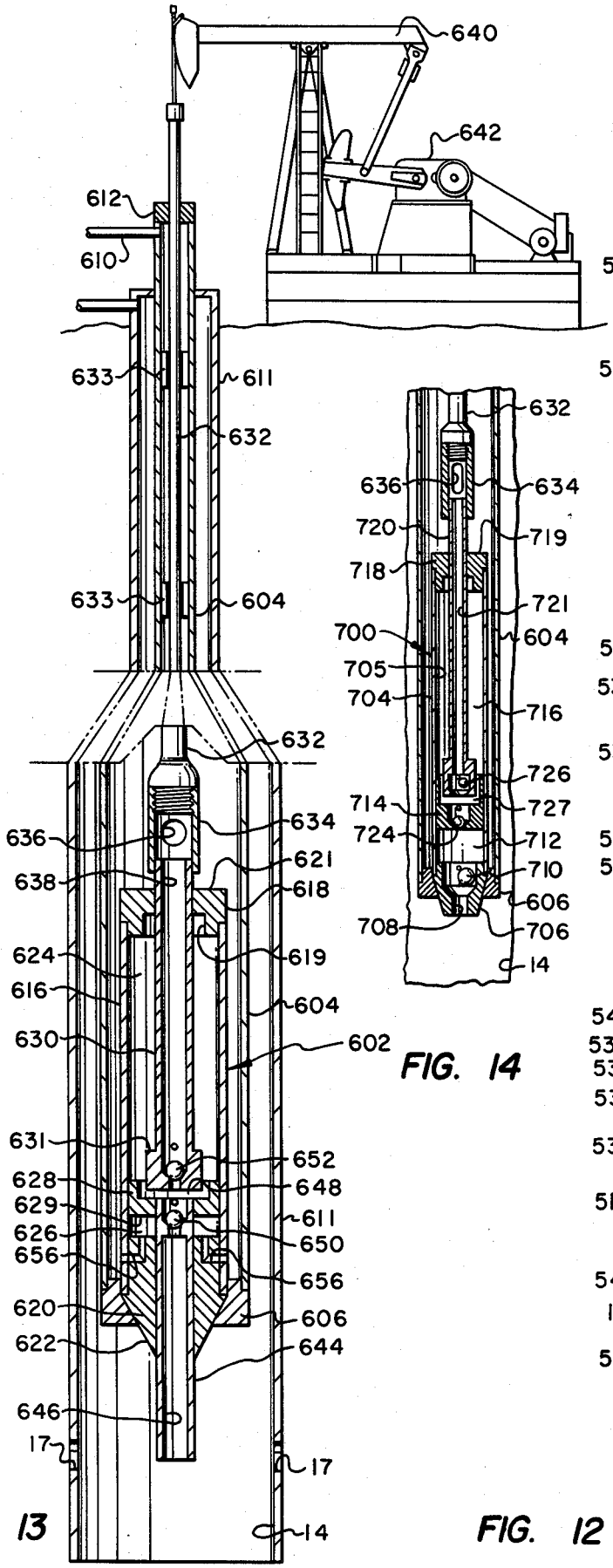
FIG. 13
FIG. 14
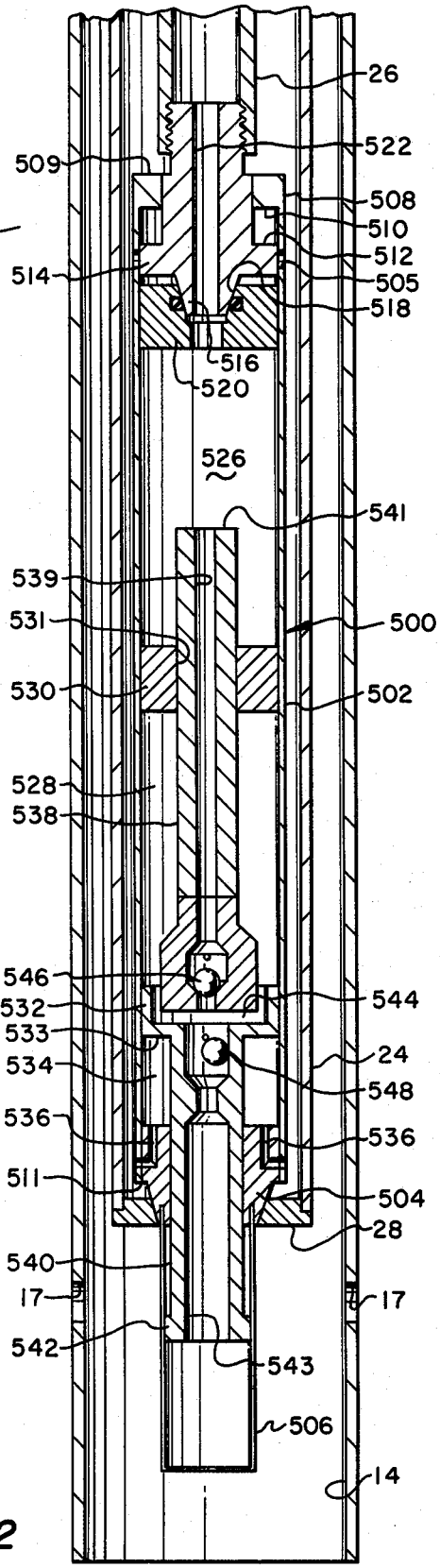
FIG. 12

HYDRAULICALLY OPERATED WELL PUMP SYSTEM

BACKGROUND OF THE INVENTION

1. Field of the Invention

The present invention pertains to a well pump system for producing well fluids. The pump system includes a reciprocating piston downhole pump which utilizes the pressure of a column of hydraulic driving fluid or a gas over liquid accumulator and a column of production fluid for driving the pump. One embodiment uses a mechanical actuating rod and production fluid pressure for driving the pump. The driving fluid may be displaced by a hydraulically driven cylinder and piston type power transfer unit on the surface.

2. Background

In the art of downhole pumps for lifting fluids from wells and other subterranean reservoirs there are several concepts which have been relatively well developed including the so-called sucker rod type pump which comprises a reciprocating piston pump disposed deep in the well at the point from which fluid is to be pumped and which is actuated from the surface solely by an elongated reciprocating rod string. There have also been several developments in downhole well pumps which are hydraulically operated in an effort to overcome some of the disadvantages of the mechanical rod type pump. Typically, prior art hydraulically operated pumps, sometimes known as power oil pumps, comprise a reciprocating piston pump located in the wellbore and having opposed pistons or piston surfaces defining power oil chambers and production fluid chambers, respectively. Hydraulic or "power" oil is pumped down the well through a suitable conduit connected to the reciprocating piston pump for actuating the pump to deliver a charge of production fluid through a delivery line to the surface. In some types of power oil pumps the power oil is mixed with the production fluid in the delivery line as a means of returning the power oil to the surface. Accordingly, this so-called power oil must be suitably treated before it can be recirculated by the power oil delivery pump back to the well pump for further energization of the well pump. This type of hydraulically operated pump is relatively complicated and requires expensive and troublesome filtering systems for treating the fluid which is used as "power" oil. Other types of hydraulically operated pumps have been developed which provide separate delivery and return conduits for the hydraulic "power oil" and, of course, a third conduit is required for the production fluid.

Those skilled in the art will appreciate that the prior art hydraulically operated pumps which utilize either mixed production and power oil or separate closed loop power oil systems can be relatively inefficient. The power oil must be circulated down the hole and returned requiring relatively complex conduit systems, in the case of a separate or isolated power oil circuit, and the circulation of mixed or separate power oil completely down through the supply conduit and through the return conduit results in frictional losses which increase the overall power requirements for a given quantity of production fluid produced. Prior art pumps are also characterized by designs which lift production fluid on both strokes of the pump thereby complicating the pump structure itself.

Known types of well pumping systems also suffer from certain shortcomings such as the inability to be effectively regulated to pump at the desired production rate of the well. In this regard, known types of pumping systems are also at a disadvantage because of the economics of producing from low production or marginal wells, particularly wells for producing petroleum fluids. There must, of course, be economic justification for producing hydrocarbon fluids from subterranean wells. If the pumping costs and the capital equipment costs exceed the expected yield of the well or a low marginal net profit results there is little incentive to develop or produce from such formations and wells.

Accordingly, there has been an ongoing need for a downhole well pump which minimizes the capital equipment cost, may be inserted in a well without substantial modification to the existing well structure, may be inserted in wells which are deviated and cannot be produced using mechanical rod actuated pumps and which should be pumped at very low or variable rates to prevent overpumping the well and damaging the formation characteristics as well as the pump mechanism.

There has also been a need for an improved well pump system which can be conveniently installed in existing wells which are relatively inaccessible or for various reasons cannot be pumped utilizing equipment which extends above the earth's surface at the wellhead or takes up a great deal of room at the wellhead.

Substantially all of the disadvantages of known types of downhole well pump systems have been overcome with the hydraulically operated and combined mechanical and hydraulically operated pump system of the present invention as will be appreciated by those skilled in the art upon reading the following.

SUMMARY OF THE INVENTION

The present invention provides an improved downhole pump system including a reciprocating piston type downhole pump which includes a piston assembly dividing the pump cylinder into pump driving fluid and pump production fluid chambers and wherein the pump is actuated utilizing the forces exerted on the piston assembly by standing columns of pump driving fluid and pump production fluid.

In accordance with the invention pump systems are provided wherein the driving fluid is maintained at a working pressure by a gas charged accumulator for maintaining a substantially constant pressure on the driving fluid. The accumulator may be formed as part of the driving fluid conduit and supplied with pressure gas at a regulated pressure. In one embodiment of the pump system the driving fluid conduit is eliminated and the gas charged accumulator is formed as part of an extension of the pump housing which is preferably arranged to interconnect the downhole pump unit with a production fluid delivery conduit from which the pump is suspended in a well. Pump production fluid is displaced by modified power transfer unit disposed on the surface and driving fluid is contained within the pump housing. The accumulator portion of the pump housing is precharged with pressure gas prior to insertion of the pump into the wellbore.

In accordance with one aspect of the present invention there is provided a well pump system wherein a substantially standing column of pump driving fluid is oscillated or reciprocated in a conduit within the well between a power transfer unit on the surface at the wellhead and a reciprocating piston pump disposed in the well at the depth desired for producing production fluid. The downhole well pump is provided with a cylinder divided into at least one production fluid chamber and one driving fluid chamber by a reciprocable piston which is reciprocated by pressure fluid forces exerted thereon by the driving fluid and the production fluid. In one embodiment of the pump the pump piston comprises a piston assembly having two piston members interconnected by an elongated tubular piston rod and the cylinder is provided with a fixed partition through which the piston rod extends to form at least two interconnected production fluid chambers and a driving fluid chamber formed between one of the pistons and the cylinder partition. In another embodiment, primarily used for low production wells, a single reciprocable piston includes opposed piston rod portions extending through cylinder partitions to form driving and production fluid chambers.

In accordance with another aspect of the invention the pump is adapted to be driven through a production fluid delivery stroke by driving fluid which is disposed in a standing column formed by a well conduit. Driving fluid is displaced from a driving fluid chamber or a power transfer unit, preferably disposed on the surface at or near the wellhead, or by fluid pressure imposed on the driving fluid from a pressure regulated source. During a pump delivery stroke production fluid is displaced from the production fluid chambers of the pump and during an intake or suction stroke driving fluid is displaced from the driving fluid chamber of the pump by a pressure force exerted on the piston by production fluid in one of the production fluid chambers while a fresh charge of production fluid is drawn into the second production fluid chamber of the pump.

In accordance with yet another aspect of the present invention there is provided a hydraulically operated well pump system wherein production fluid and driving fluid are maintained isolated from each other through a coaxial conduit system in the well including, in one embodiment, conventional well production tubing in which the downhole pump is inserted and positioned at the desired depth for operation and wherein the downhole pump is supported in the well at one end of the well tubing by a pump head portion and wherein the pump is held in position by the weight of a production fluid delivery conduit connected to one end of the pump. Pump driving fluid is disposed in the outer conduit in a standing column and which fluid is oscillated in the column to effect operation of the pump. Accordingly, pumping losses of the driving fluid are minimized and the entire quantity of driving fluid utilized is not required to be handled at the surface or treated prior to reinjection into the well as with certain prior art hydraulically operated well pumps.

The coaxial arrangement of the driving fluid conduit and the production fluid conduit minimized problems associated with handling the pump for insertion into and withdrawal from the well, which together with unique vent valves formed between the production fluid conduit and the pump body and between the pump body and the driving fluid conduit, respectively, permit withdrawal of the pump assembly from the well in a so-called condition without leaving production or driving fluid in the conduits as they are extracted from the well.

The present invention also provides an improved hydraulically operated pump system for a downhole hydraulic pump having a unique power generating or transfer apparatus which is relatively compact, has a low physical profile or envelope and is adapted to be mechanically or hydraulically actuated for oscillating the driving fluid column and for effecting delivery of a net amount of production fluid with each stroke of the downhole pump. In certain embodiments of the power transfer apparatus there is provided a cylinder member having a piston assembly disposed therein and dividing the cylinder into opposed production fluid and driving fluid chambers. Production fluid is drawn into and through the production fluid chamber during a delivery stroke of the downhole pump and driving fluid is displaced from the power transfer apparatus to drive the downhole pump piston through its delivery stroke. During a return stroke of the power transfer piston assembly driving fluid is transferred into the driving fluid chamber of the power transfer apparatus and at least a portion of production fluid displaced from the production fluid chamber of the downhole pump is returned to the downhole pump to move the pump through a charging stroke wherein a pump production fluid delivery or transfer chamber is recharged.

In accordance with still another aspect of the present invention a power transfer apparatus is provided for a hydraulically operated downhole pump comprising a horizontally opposed reciprocating piston mechanism having a first piston disposed in a first cylinder and dividing the cylinder into a pump driving fluid transfer chamber and a production fluid transfer and delivery chamber or, alternatively, an inert charge fluid chamber. The first piston is connected to a second opposed piston which is disposed in a second cylinder isolated from the first cylinder and dividing the second cylinder into opposed hydraulic power fluid chambers which are operable to receive power fluid alternately from a hydraulic power source. The power transfer apparatus may also be provided with a third cylinder opposed to the second cylinder and provided with a third piston aligned with and connected by a common rod to the first and second pistons and forming the driving fluid chamber and an inert charge fluid chamber to isolate the respective power fluid chambers from the production and driving fluid chambers.

Further in accordance with an embodiment of the power transfer apparatus, the hydraulic power source comprises a positive displacement reversible hydraulic pump which is operable to alternately deliver hydraulic fluid to the opposed power fluid chambers. The power transfer apparatus is preferably arranged with a horizontal balanced opposed reciprocating piston assembly which requires minimum foundation structure and provides a low dimensional profile. The power transfer apparatus may be easily disposed below ground level for aesthetic or functional reasons. Moreover, the power transfer apparatus may be adapted for other pumping applications.

In accordance with yet a further aspect of the present invention there is provided a downhole hydraulically operated well pump which is of relatively uncomplicated construction and is provided with a reciprocable double piston disposed in a cylinder in such a way as to provide two spaced apart production fluid transfer and delivery chambers, a production fluid inlet chamber and a pump driving fluid chamber. The pump is adapted to be disposed in a well conduit such as conventional oil well production tube and is adapted to be lowered to its working position on the distal end of a production fluid delivery conduit.

The improved downhole pump of the present invention is also characterized by an arrangement of one way flow control valves disposed in one of the pistons and in a hollow piston rod interconnecting the opposed pistons to provide for delivery of production fluid from two separate chambers in the pump during a delivery stroke of the piston assembly together with filling of a production fluid intake chamber. The flow control valve arrangement also provides for improved volumetric efficiency by minimizing the residual quantity of production fluid subject to compression during a charging or fluid transfer stroke of the pump piston assembly. The pump may be provided in a dual delivery chamber configuration or a triple delivery chamber configuration.

The downhole pump advantageously utilizes a disposable hydraulic fluid which may be of higher density than the production fluid, such as water, and maintains the driving fluid isolated from the production fluid. The power transfer apparatus also isolates the hydraulic power fluid from both the downhole pump driving fluid and the production fluid.

One embodiment of the pump system uses a mechanical actuating or sucker rod string for reciprocating the pump piston assisted by a pressure force exerted on the piston by the column of production fluid to reduce the rod uplift actuating effort.

The pump system of the present invention is particularly adapted for widely variable pumping rates as controlled by the power transfer apparatus whereby the delivery of production fluid from a particular well may be controlled in accordance with well characteristics. The pressure of well production fluid in the wellbore at the downhole pump inlet can be utilized to assist in pump operation and control the pumping rate if, for example, production fluid pressure should decline in the wellbore. The downhole pump may be utilized in conjunction with conventional oil well production fluid tubing and may be inserted through such tubing in virtually any type of well in which the tubing can be inserted. The pump may be inserted on the end of a fluid delivery conduit which can be a continuous tube which is injected into and withdrawn from the well using conventional, so-called coiled tubing injector equipment.

The above-noted features and advantages of the present invention as well as additional superior aspects thereof will be further appreciated by those skilled in the art upon reading the detailed description which follows in conjunction with the drawing.

BRIEF DESCRIPTION OF THE DRAWING

FIG. 12 is a somewhat schematic diagram of a second alternate embodiment of a downhole pump;

FIG. 13 is a schematic diagram of a second alternate embodiment of the well pump system;

FIG. 14 is a somewhat schematic illustration of an alternate embodiment of a rod actuated pump for the system of FIG. 13;

DESCRIPTION OF THE PREFERRED EMBODIMENTS

Figure 1:
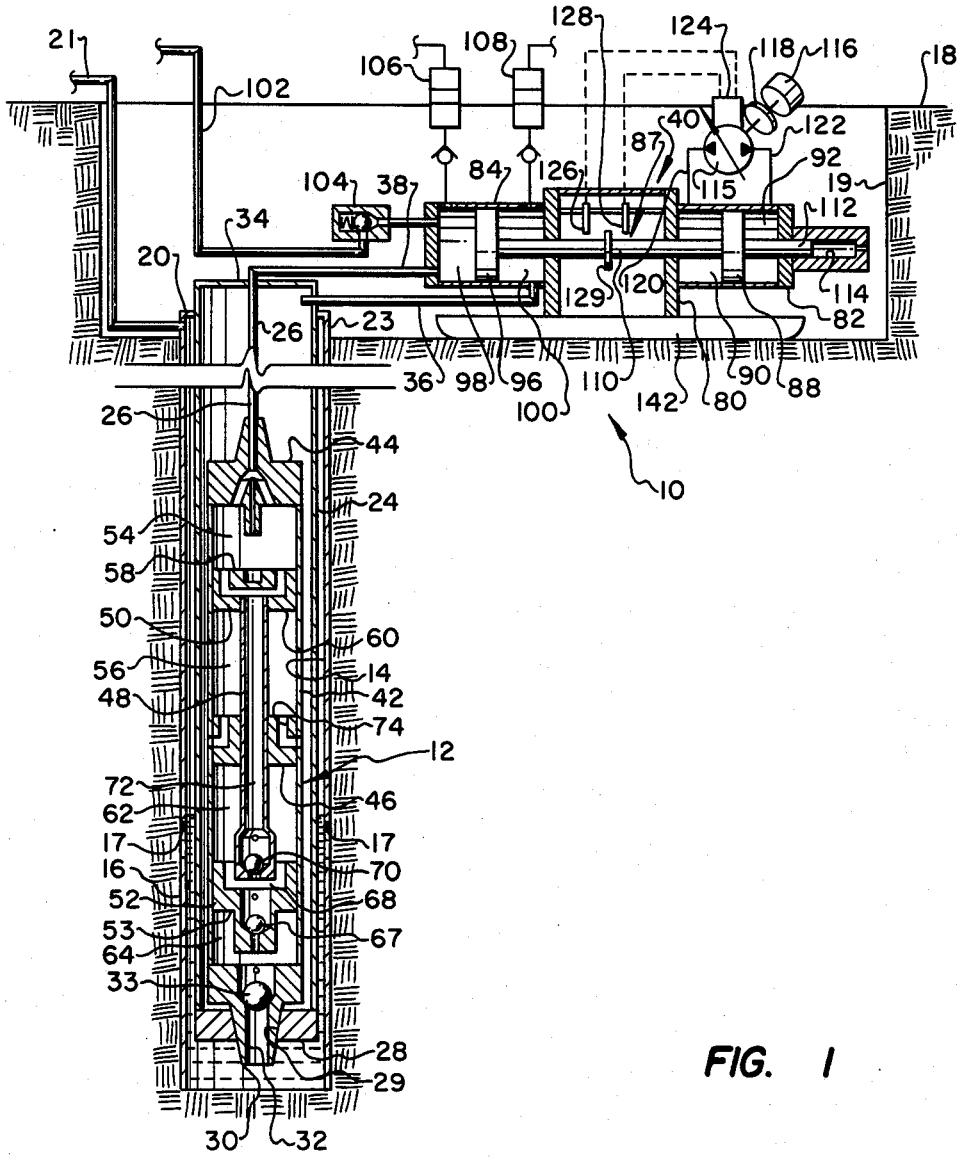
FIG. 1 is a diagram, in somewhat schematic form, of the hydraulically operated well pump system of the present invention.

In the description which follows like parts are marked throughout the specification and drawing with the same reference numerals, respectively. The drawing figures are not necessarily to scale and certain features of the invention have been shown exaggerated in scale or in schematic or diagrammatic form in the interest of clarity and conciseness.

Referring to FIG. 1, there is illustrated in somewhat schematic forn a unique hydraulically operated well pumping system in accordance with the present invention and generally designated by the numeral 10. The pumping system 10 includes a downhole pump 12 adapted to be inserted in a wellbore 14. The wellbore 14 may be a cased or uncased well and for the sake of description herein will be indicated to have a casing 16 which has been suitably perforated at 17 to allow subterranean formation fluids to flow into the wellbore 14. The casing 16 may extend substantially to the earth's surface 18 as provided by a shallow pit 19 and can be capped at 20 to form a wellhead 23. Suitable conduit means 21 are provided below or above the surface 18 for pressurizing the wellbore 14 and/or for conducting gas away from the wellbore, if required.

The pumping system 10 also includes an arrangement of coaxial conduits comprising an outer driving fluid conduit 24 and an inner production fluid conduit 26 which is arranged preferably coaxially within the driving fluid conduit. The driving fluid conduit 24 is preferably provided at its lower end with an end cap 28 having a central bore 29 through which a tapered bottom head portion 30 of the pump 12 projects and forms a fluid inlet port 32. The conduit 24 may, in fact, be characterized as conventional so-called production tubing typically used for producing hydrocarbon fluids from subterranean wells. The conduit 24 may extend to the surface and is provided with a cap 34 to form a closed conduit. The conduit 24 may, in fact, terminate in a typical wellhead apparatus, not shown, including the upper end of the casing 16. The aforementioned wellhead apparatus is not believed to require illustration in detail in order to understand and practice the present invention. The production fluid conduit 26 typically extends through the end cap 34 of the driving fluid conduit 24 and both the driving fluid conduit and the production fluid conduit include respective conduit extension portions 36 and 38 which lead to a power transfer apparatus for the pumping system 10, and which is generally designated by the numeral 40.

Figure 2:
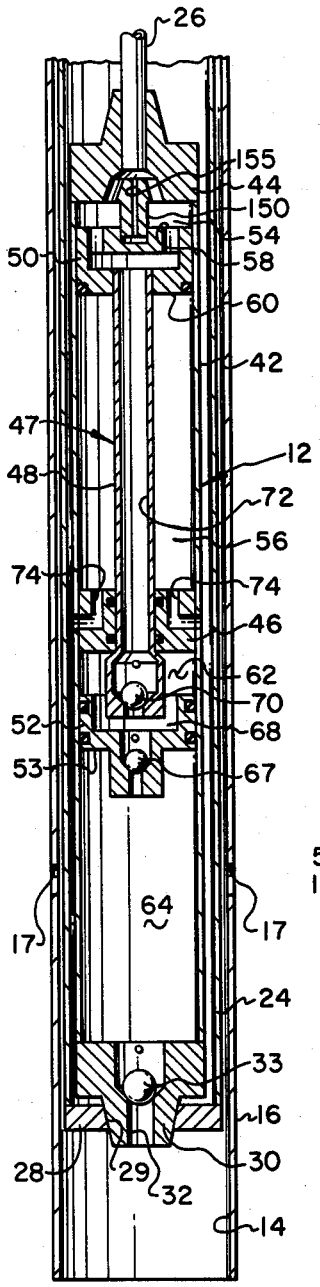
FIGS. 2 through 5 illustrate the downhole pump of the present invention in various positions in an operating cycle.

Referring to FIGS. 1 and 2, the downhole pump 12 is further characterized by an elongated cylindrical housing 42 which is closed at one end by the head part 30 and at the other end by a second head part 44 connected to the production fluid conduit 26. The housing 42 includes a partition formed therein and through which extends an elongated tubular piston rod 48 which is connected at its upper end to a first piston 50 and the lower end of the piston rod 48 is connected to a second piston 52. The first piston 50 is slidably disposed in the housing 42 and divides the housing into a production fluid transfer chamber 54 and a driving fluid chamber 56. Accordingly, production fluid acts downwardly on a piston face 58 and driving fluid may be admitted to the chamber 56 to act upwardly on the opposite piston face 60 of the piston 50. The chamber 54 operates to transfer production fluid from a chamber 62 on an upstroke of piston assembly 47 and functions as a production "power" fluid chamber on a piston downstroke.

The piston 52 divides the lower end of the housing 42 into the production fluid delivery chamber 62 and a production fluid intake chamber 64 which is operable to be in communication with the wellbore 14 through the intake port 32. The piston assembly 47, comprising the tubular rod 48 and the spaced pistons 50 and 52, is provided with passage means for conducting production fluid from the chamber 64 to the chambers 54 and 62 as well as passage means for conducting production fluid from the chamber 62 to the chamber 54. A ball type one way or check valve 67 is supported by the piston 52 and interposed in a passage 68 which interconnects the chambers 64 and 62. A second ball type check valve 70 is interposed between a passage 72 in the piston rod 48 and the chamber 62. A third ball type check valve 33 may be provided, as shown, interposed in the port 32 and operable for admitting production fluid from wellbore 14 to the chamber 64.

In response to an upward movement of the piston assembly 47 toward head 44 production fluid is simultaneously displaced from chamber 62 and chamber 54 into the production fluid conduit 26 toward the power transfer apparatus 40 under the urging of pressure fluid admitted to the driving fluid chamber 56 through passages 74 in the partition 46. The passages 74 open through the housing 42 and are operable to communicate the chamber 56 with the interior of the driving fluid conduit 24 at all times. Thanks to the substantial fluid pressure exerted on the piston face 60 by a standing column of fluid in the driving fluid conduit 24, the piston assembly 47 may be driven through a fluid delivery stroke, during which the clock valve 67 is closed and the check valve 70 is open, whereby production fluid is transferred out of the chamber 62 and the chamber 54 toward the power transfer apparatus 40. During a production fluid delivery stroke check valve 33, if used, opens to admit production fluid from wellbore 14 to chamber 64. The pressure of a standing column of production fluid in the wellbore 14 may be sufficient to act on piston face 53 to assist in driving the piston assembly 47 through a production fluid delivery stroke.

The standing columns of fluid in the conduits 24 and 26 are considered to be essentially of the same length, so that the fluid pressures acting on the pump piston 50 due to fluid in the conduits 24 and 26 depend on respective fluid densities. The face areas 58 and 60 of the piston 50 may be selected in combination with the respective densities of the production fluid and the driving fluid such that a net resultant force due to the pressure of the fluid columns acting on the piston assembly 47 will cause the piston assembly 47 to be balanced, biased towards the completion of an upward delivery stroke or towards the completion of a downward intake or fluid transfer stroke, respectively, as well conditions might require. In the pump system 10 water may be used as the driving fluid, having a density which may be greater than the well fluid. The opposed piston face areas of piston 50 may be selected such that when the production fluid conduit 26 is filled with production fluid and the conduit 24 is filled with driving fluid the piston assembly 47 is balanced, if desired, or biased downward, viewing FIG. 1, to maximize the volume of the chambers 54 and 62. Moreover, the upward bias force on the piston assembly 47 can be controlled in accordance with a predetermined pressure to be maintained in wellbore 14 and acting on piston face 53.

The power transfer apparatus 40 is characterized by a frame 80 supporting horizontally opposed cylinder members 82 and 84. The cylinder 82 is provided with a cylindrical bore in which a piston 88 is disposed and divides the bore into opposed pump chambers 90 and 92. The cylinder 84 is also provided with a cylindrical bore in which is disposed a piston 96 dividing the bore into a production fluid chamber 98 and a driving fluid chamber 100. The driving fluid conduit 24, 36 is in communication with the chamber 100 and the production fluid delivery conduit 26, 38 is in communication with the chamber 98. A production fluid delivery conduit 102 is also in communication with the chamber 98 and has a minimum pressure valve 104 interposed therein for maintaining a miminum pressure in the chamber 98 in response to reciprocation of the piston 96 to scavenge the chamber 98. The delivery conduit 102 may be connected to a suitable reservoir, not shown, or other means for receiving production fluid from the wellbore 14. The chambers 98 and 100 may be maintained at a predetermined minimum pressure by accumulators 106 and 108, respectively, for maintaining a predetermined minimum pressure of the production fluid and the driving fluid so as to negate any adverse effects resulting from compressibility of the respective fluids in particularly deep wells. The accumulators 106 and 108 may be connected to respective sources of pressure fluid, not shown, at controllable pressures. The compressibility of the production and driving fluids themselves may serve the accumulator function with an initial charge pressure applied to the fluid columns and considering elastic expansion of steel or similar metal tubing used for the conduits 24 and 26.

The pistons 88 and 96 are preferably arranged coaxial with each other in their respective cylinders and are interconnected by a piston rod 110 supported for sliding movement on the frame 80 to form a piston assembly 87. The piston rod 110 includes an integral extension 112 received in a bore 114 of an extension of the cylinder 82 so that the opposed transverse faces of the piston 88 are of equal axial projected areas. The power transfer apparatus 40 is actuated by suitable means including a hydraulic pump 115 drivably connected to a suitable motor 116 through a flywheel 118. The fluid intake and delivery conduits 120, 122 of pump 115 are connected to the cylinder chambers 90 and 92 for delivering hydraulic fluid to the respective chambers in a cyclic manner to effect reciprocation of the piston assembly 87. The pump 115 may be of a type which is operable to reverse the direction of flow in the respective fluid conducting lines 120 and 122. Alternatively, the lines 120 and 122 could be in communication with a reversing valve between the pump 115 and the cylinder 82.

In accordance with an embodiment of the invention the pump 115 is of the so-called overcenter axial piston type wherein flow through the lines 120 and 122 may be reversed by actuation of a suitable pump controller 124 in response to signals received from suitable control means such as spaced apart adjustable limit switches 126 and 128 which are engageable, respectively, by an actuator 129 mounted on piston rod 110. The relative positions of switches 126 and 128 on frame 80 may be adjusted to control the stroke length of the pistons 88 and 96 and, accordingly, the stroke of pump 12 by controlling the flow direction of fluid delivered by pump 115 to the respective chambers 90 and 92. Alternatively, the controller 124 may be mechanically interconnected with the piston rod 110 in such a way that, as the piston assembly 87 reaches a predetermined limit of a stroke in one direction, the pump controller 124 is actuated to reverse the direction of flow in the pump fluid lines 120 and 122 to reverse the direction of movement of the piston assembly 87. The pump 115 may be of a type manufactured by the Rexroth Corporation, Mobile Hydraulics Division, Wooster, Ohio as their type AA4V. This is a swashplate type variable displacement overcenter axial piston pump designed for closed circuit power transmission systems. Certain detailed features including filters, heat exchangers, and conventional pump controls are not shown in the diagram of FIG. 1 and are not believed to be necessary in order to enable one skilled in the art to practice the instant invention. Suffice it to say that the pump 115 is reversible in the sense that it is operable to effect reversal of hydraulic fluid flow in the conduits connected to the pump to effect reciprocation of the piston assembly 87.

Those skilled in the art will appreciate that the power transfer apparatus 40 may be modified to include other means for reciprocating the piston 96 although the hydraulic power source comprising the pump 115, motor 116, and flywheel 118 provides a particularly compact low profile apparatus which may be mounted on a suitable skid 142. Moreover, the apparatus 40 may be mounted remote from the wellbore 14 or may be disposed in pit 19 below the surface 18 for aesthetic and/or functional reasons depending on the location of the well in which the pumping system 10 is being used.

Referring now to FIGS. 2 through 5, a typical operating cycle of the pumping system 10 will be described. FIG. 2 shows the pump 12 in the maximum upstroke position wherein driving fluid has displaced the piston assembly 47 to sweep the chambers 54 and 62 of production fluid. The combined displacement volume of chambers 54 and 62 exceeds the displacement volume of chamber 98 by the volume of chamber 62, preferably. Accordingly, during an upstroke of the piston assembly 47 a net amount of production fluid equal to the volume of chamber 62 passes through chamber 98 and is delivered to line 102. In the position of pump 12 shown in FIG. 2 the power transfer apparatus piston assembly 87 would be displaced its maximum distance to the right, viewing FIG. 1. The direction of flow through the lines 120 and 122 is then reversed such that hydraulic fluid from the pump 115 is being supplied to the chamber 92 and scavenged from the chamber 90 whereby the piston assembly 87 will be moved leftward, viewing FIG. 1, to displace production fluid from the chamber 98 back into conduit 26. As production fluid is displaced from the chamber 98, driving fluid may flow from the conduit 24 into the chamber 100. The weight of the column of fluid in the production conduit 26 will effect movement of the piston assembly 47 downward, viewing FIG. 3, to expand the chambers 54 and 62.

As the pump 12 is moved through a stroke cycle to the position illustrated in FIG. 2, production fluid in the wellbore 14 has flowed through port 32 into chamber 64 to substantially fill this chamber with production fluid. Accordingly, as the piston assembly 47 commences moving downward to the positions indicated in FIGS. 3 and 4, valve 33, if used, closes to prevent displacement of production fluid back into the wellbore 14 and valve 70 seats under the urging of fluid in chamber 54 and passage 72 as fluid in the conduit 26 returns into the chamber 54 to urge piston 50 downwardly. During the downstroke of piston assembly 47 valve 67 unseats to permit transfer of fluid from chamber 64 to chamber 62. Typically, the maximum displacement volume of chamber 64 is not substantially more than the maximum displacement volume of chamber 62, although if valve 33 is omitted this volume relationship is not significant. As the piston assembly 47 is moving downwardly driving fluid is displaced out of chamber 56 and upward through the conduit 24 and toward chamber 100.

Figure 4:
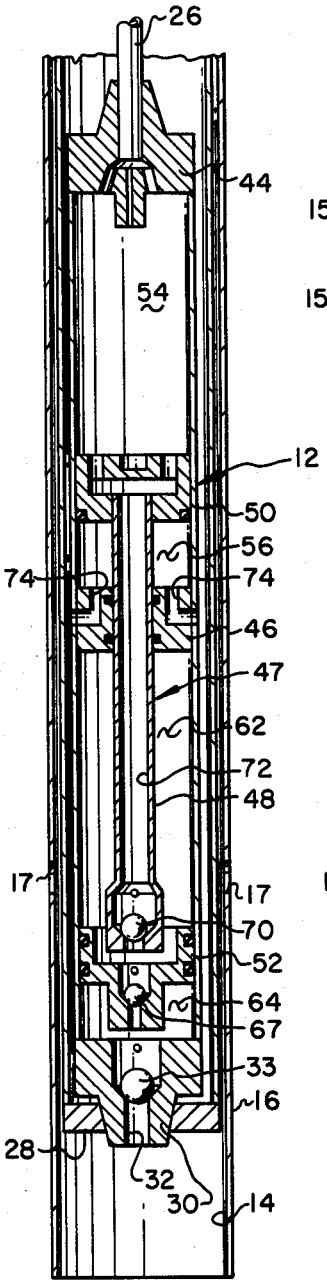

When the piston assembly 47 reaches the lower limit of its stroke as indicated by the position of the piston assembly in FIG. 4, the chambers 54 and 62 are filled completely with production fluid from conduit 26 and transferred from the intake chamber 64, respectively. At this point, the power transfer apparatus 40 has reversed the direction of movement of the piston assembly 87 to commence displacing driving fluid out of chamber 100, through the conduit 24 and into chamber 56 whereby the piston assembly 47 is now urged upward which effects closure of the valve 67. As the piston assembly 47 moves from the FIG. 4 position, through the FIG. 5 position and back to the FIG. 2 position production fluid is displaced from the chamber 62 through valve 70 and passage 72 and to chamber 54, and, simultaneously, production fluid is being displaced from chamber 54 through the production delivery conduits 26 and 38 into and through the chamber 98 and into the production delivery line 102. During movement of the piston assembly 47 from the FIG. 4 position to the position of FIG. 2 chamber 64 will again fill with production fluid.

Figure 5:
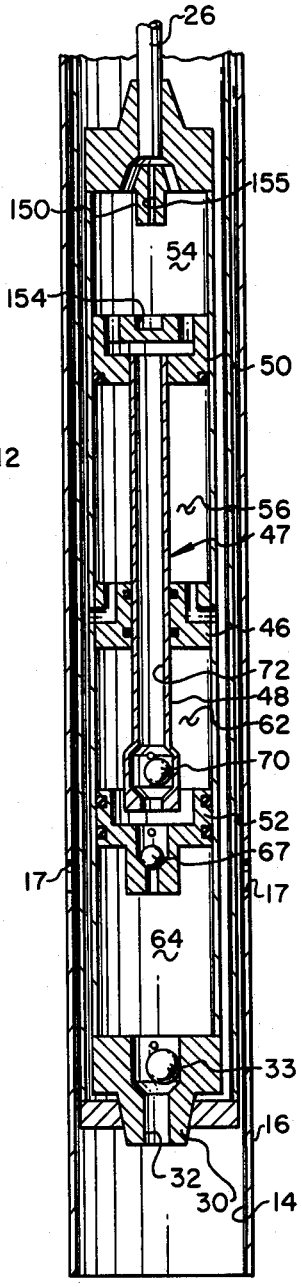

As the piston assembly 47 moves upward through the delivery stroke illustrated in FIG. 5 to the position illustrated in FIG. 2, the piston 50 will engage a hydraulic cushion forming means comprising a generally cylindrical projection 150 disposed in the chamber 54 and forming part of the head assembly 44. The projection 150 enters a chamber 154 formed in the face of the piston 50 whereby fluid trapped in the chamber 154 by the projection 150 is allowed to flow at a substantially throttled rate through a suitable passage 155 formed in the head 44.

Figure 3:
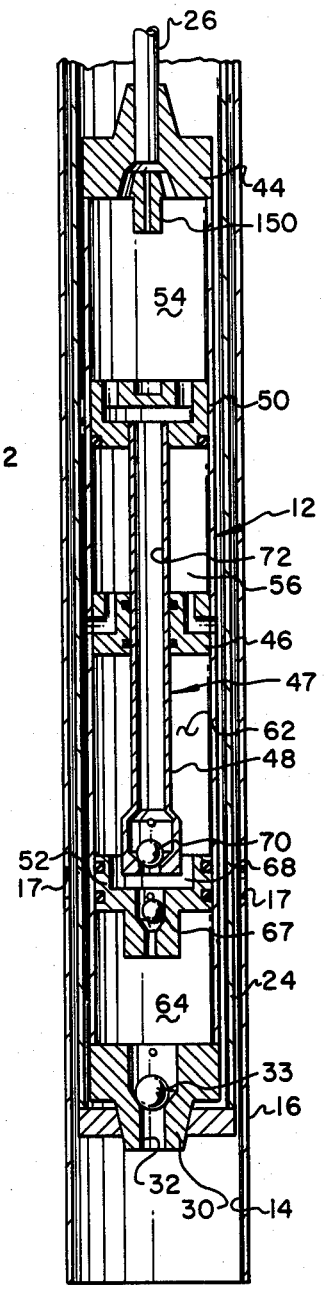

Accordingly, the pump 12 is operable to deliver a net quantity of production fluid comprising the displacement of the chamber 62 as the piston assembly 47 moves through a cycle from the position illustrated in FIG. 2 through the positions illustrated in FIGS. 3, 4 and 5 and back to the position illustrated in FIG. 2. This displacement takes place with relatively low frictional flow losses of the driving fluid since the fluid only oscillates over a very limited distance in a relatively large diameter, substantially unrestricted conduit. Moreover, depending on the density of the driving fluid in relation to the density of the production fluid and the selection of the effective axially projected areas of the piston faces 58 and 60, the pump piston assembly 47 may be biased in an upward or downward stroke limit position or balanced by the net resultant forces acting on the piston assembly. Of course, the height of the column of production fluid standing in the wellbore 14 is also operable to bias the piston assembly 47 upward through its action on the axially projected face area 53 of the piston 52. As previously mentioned, the power transfer apparatus 40 may be adapted to operate at a virtually infinitely variable rate whereby the piston assembly 47 may be stroked through a so-called suction and discharge stroke cycle at a rate which matches the desired rate of fluid delivery from the wellbore.

Although the height of the column of production fluid in the wellbore 14 results in a relatively low pressure on the piston face 53 pressure force acting on this face may be significant enough so that in conjunction with providing a pressure relief setting for the hydraulic fluid being discharged from the pump 115 through line 120, that during a cycle of the power transfer unit to force driving fluid into the chamber 56, if the pressure force urging the piston assembly 47 upwardly is not sufficient considering the total force exerted on the piston face 53 and piston face 60 pressure fluid being bypassed from the line 120 may be sensed as to flow or heat build up to shut down the pump 12 until pressure in the wellbore 14 again increases to a point sufficient to contribute to the lifting force on the piston assembly 47. In this way control of the pump rate of a well may be obtained without the danger of overpumping.

The use of the check valve 33 is dependent on the production fluid flow conditions into the wellbore 14. Typically, the displacement volume of chamber 64 is selected to be slightly greater than the displacement volume of chamber 62. The check valve 33 should be installed in applications of the pump 12 wherein a relatively high percentage of gases are dissolved in or entrained in the production fluid. Since pressure in the wellbore 14 acting on the check valve 33 effects opening of the valve on a downstroke of the piston assembly 47 use of the check valve 33 aids in preventing overpumping or so called gas lock of the pump. In wells with very high liquid content of the production fluid the check valve 33 is preferably omitted.

Figure 6:
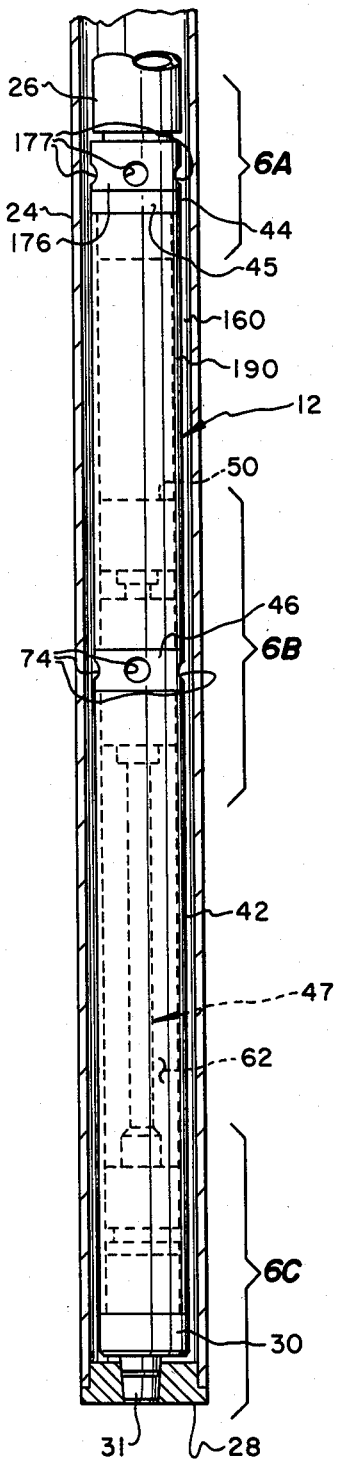
FIG. 6 is a longitudinal elevation view of the downhole pump inserted in a wellbore.
Figure 6A:
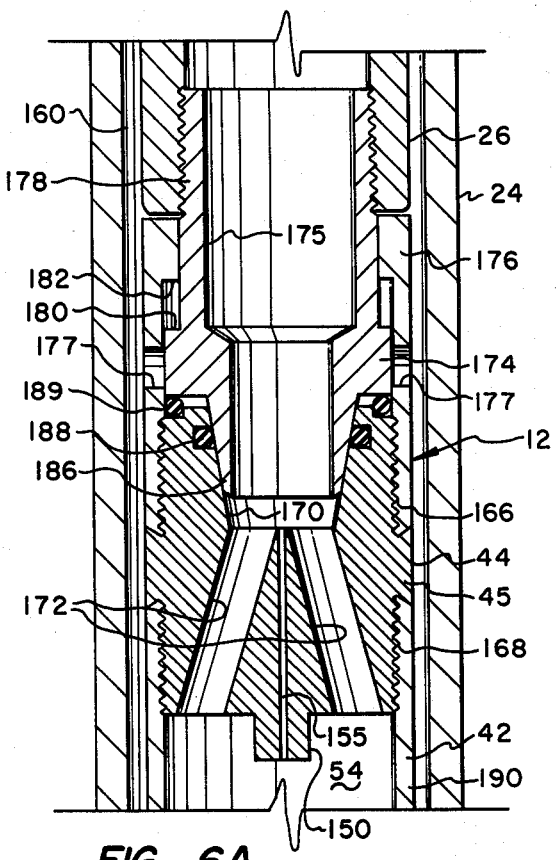
FIGS. 6A, 6B and 6C are partial longitudinal central section views of respective portions of the downhole pump as indicated in FIG. 6.
Figure 7:
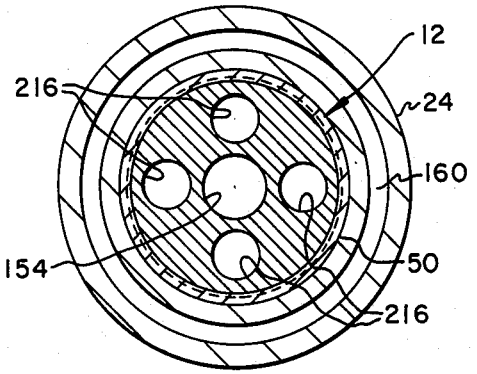
FIG. 7 is a section view taken along the line 7—7 of FIG. 6B.
Figure 6B:
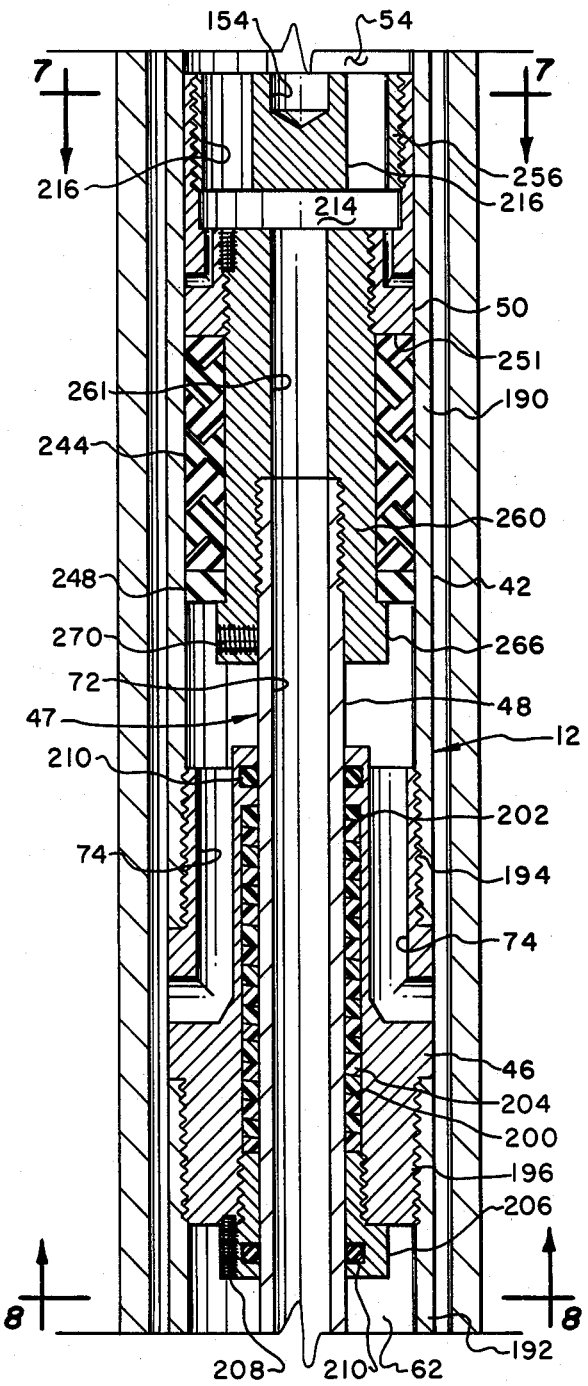
Figure 6C:
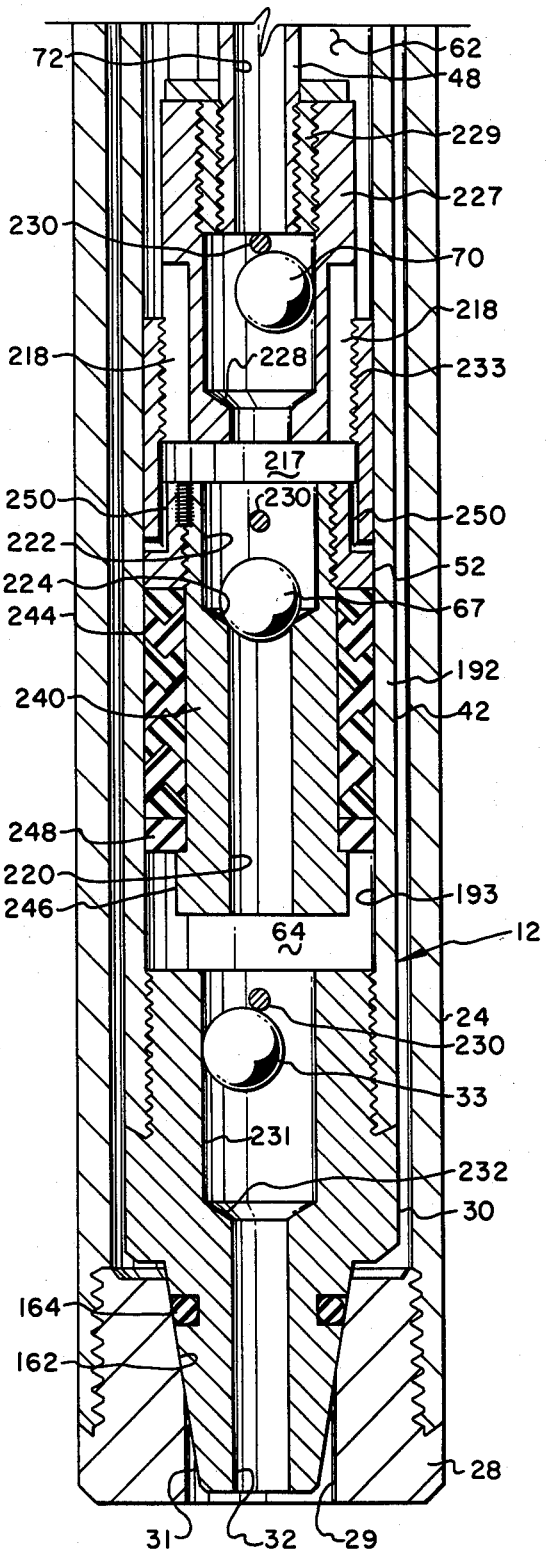

Referring now to FIGS. 6, 6A and 6C, the pump 12 is shown in FIG. 6 disposed in the lower end of the driving fluid conduit 24 in fluid sealing engagement with the conduit end cap 28. The pump 12 is characterized as a long slender cylindrical structure defined by the housing 42, the lower head member 30 and the upper head member 44. The housing 42 is dimensioned to be disposed in the driving fluid conduit 24 to leave a substantially annular space 160 between the housing 42 and the interior bore wall of the driving fluid conduit. The pump 12 is centered within the interior of the driving fluid conduit 24 by a frusto-conical shaped projecting end portion 31 of the head 30 which is adapted to engage a seat 162 formed as part of the bore 29 in end cap 28. An o-ring seal 164 is provided for sealing engagement between the end portion 31 and the seat 162. As shown in FIG. 6A, the head member 44 includes a body 45 with opposed externally threaded portions 166 and 168 and a frusto-conical seat 170 which is in communication with the passage 155 and with flow passages 172 opening into the chamber 54.

A coupling member 174 is retained connected to the pump 12 by a retaining collar 176 threadedly engaged with the portion 166 of the body 45 and retaining the coupling member 174 for limited axial sliding movement relative to the head member 44. The upper end 178 of coupling member 174 is threadedly connected to the lower end of the production fluid conduit 26 and is engageable with the retaining collar 176 at cooperating shoulders 180 and 182. The lower end of the coupling member 174 comprises a frusto-conical shape closure member 186 which is engageable with the seat 170 to form a fluid-tight seal including cooperating seal rings 188 and 189. The coupling member 174 includes an axial flow passage 175 which communicates the chamber 54 with the production fluid conduit 26 and, in response to axial upward lifting movement by the conduit 26, the coupling member 174 is adapted to move axially a limited distance to disengage from the seat 170 and allow fluid in the interior of the conduit 26 to flow out into the annular passage 160 through radially extending ports 177 formed in the sidewall of the retaining collar 176.

When the pump 12 is being inserted into the conduit 24 fluid may be displaced through the space 160 and/or through the passage formed by seat 162 into the wellbore 14 if the conduit 26 has a standing column of fluid therein. Once the pump 12 is lowered to engage the end portion 31 with the seat 162, the bottom end of the space 160 formed by the conduit 24 is sealed and the conduit may be filled with pump driving fluid such as water. Although fluid will not be standing in the wellbore 14 from the formation to the surface, in most cases, some fluid will always be present at a height greater than the working position of the pump 12. Accordingly, as the pump is lowered toward engagement with the end cap 28, the chambers 54, 56, 62, and 64 will fill with fluid present in the wellbore and in the interior of the conduit 24. After the priming action which occurs inherently with positioning the pump 12 in a wellbore having fluid present therein the conduit 24 is then filled with the pump driving fluid. The amount of well or production fluid present in the wellbore 14 and the interior of the conduit 24 and which enters the chamber 56 is typically negligible in proportion to the total amount of fluid added after seating of the pump 12 in the end cap 28. However, if the fluid level present in the wellbore extends substantially toward the surface 18 the pump 12 should be lifted from engagement with the end cap 28 and water or another selected driving fluid pumped down into the interior of the conduit 24 and into the wellbore so that substantially all of the driving fluid during operation of the pump comprises a selected fluid column instead of the fluids naturally present in the wellbore.

Prior to pulling the pump 12 out of conduit 24 for modification or repair, the conduit 26 would typically be full of fluid. However, as the pump is lifted upward out of its seated condition, as shown in FIGS. 6, 6A and 6C, the coupling member 174 will move upward relative to the retaining collar 176 to permit fluid to flow out of the conduit 26 through the passage 175 and the ports 177 into the interior of the conduit 24. This permits pulling the pump 12 and the production fluid conduit 26 in a so-called dry condition which is desirable during pump servicing and other operations requiring withdrawal of the conduit 26 from the well.

Referring further to FIGS. 6A, 6B and 6C the housing 42 is characterized by two elongated tubular members 190 and 192 which are both provided with suitable internally threaded portions on their opposite ends. The housing member 190 is threadedly connected to the lower threaded end portion 168 of the head member 44 and to an upper externally threaded portion 194 of the partition member 46. The partition member 46 includes an opposed externally threaded end portion 196 coupled to one end of the lower housing member 192. The opposite end of the housing member 192 is threadedly coupled to a cooperating threaded portion 197 of head member 30.

Figure 8:
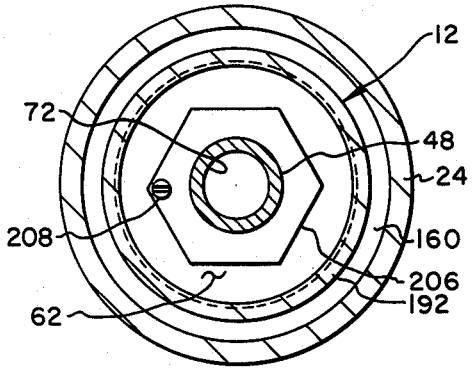
FIG. 8 is a transverse section view taken along the line 8—8 of FIG. 6B.

Referring to FIGS. 6B and 8, the partition member 46 includes an elongated central bore 200 which is threaded at its lower end and is formed with a transverse shoulder 202 at its upper end. The bore 200 forms a stuffing box for receiving suitable packing 204 which is retained in the bore by a packing nut 206. The nut 206 is suitably locked by a set screw 208 threadedly engaged therewith and with the lower end face of the partition 46. The packing 204 sealingly engages the tubular rod 48 of the piston assembly 47. O-ring seal members 210 are disposed in the partition 46 and in the packing nut 206 and also engage the rod 48 in sliding sealing engagement therewith. The production fluid flow passage 72 extends from the valve 70 to a chamber 214 formed in piston 50, FIG. 6B. A plurality of axially extending passages 216 open from the chamber 54 into the piston chamber 214. In like manner, the passage 72 may be in communication with a chamber 217 in piston 52, FIG. 6C, which is in communication with the chamber 62 through axially extending channels forming passages 218 formed in a separable, generally cylindrical piston member 227 forming a part of piston 52. The chamber 217 is also operable to be in communication with a passage 220 formed in the piston 52 and which opens into a further passage formed by an enlarged bore 222 for the check valve 67. The check valves 67, 70 and 33 are characterized as spherical ball type closure members and the valve 67 is engageable with a seat surface 224 formed between the passages 220 and 222. In like manner, the valve 70 is engageable with a seat surface 228 formed in the piston member 227 which is threadedly engaged with piston 52 at 233 and defines the passage 218. The piston rod 48 is secured to the piston member 227 by a nut 229 which is threadedly engaged with one end of the rod and with member 227 to provide for disassembly of the piston assembly 47 and access to the check valve closure members 67 and 70. Thanks to the arrangement of valves 67 and 70 a minimum amount of production fluid is retained in chamber 62 at the end of a production fluid delivery stroke. Accordingly, upon expansion of chamber 62 very little fluid is subject to release of entrained gas thereby avoiding a gas lock condition wherein fluid will not flow into chamber 62 from chamber 64 due to expansion of gas from fluid remaining in chamber 62. The valves 67 and 70 are also retained for limited movement by suitable retaining pins 230. The valve 33 is movable within an enlarged diameter passage 231 intersecting the passage 30 and forming a valve seat 232. A retaining pin 230 is also supported on the head member 30 for retaining the valve closure member within the passage 231.

The piston 52 includes an axially extending reduced diameter member 240 forming the passages 220 and 222 and operable to support a suitable chevron packing 244 for sealing engagement with the bore wall 193 of housing member 192. The piston member 240 in effect comprises a packing nut which is threadedly engaged with the piston 52 and has a head portion 246 engageable with a packing retaining washer 248. Fluid relief or lubricating passages 250 are formed in the piston 52 and open from chamber 217 to the bore wall 193 of the housing member 192.

Referring to FIG. 6B, the piston 50 is of similar construction and includes a removable head member 256 threadedly engaged therewith and defining the passages 216 and the cushion chamber 154. A separable packing nut 260 is threadedly engaged with the piston 50 and retains a chevron packing assembly 244 between a shoulder 251 and a washer 248. The nut 260 is provided with internal threads for threadedly coupling the piston 50 to the rod 48 and the nut 260 includes a passage 261 interconnecting chamber 214 with passage 72. A set screw 270 is threadedly engaged with the head 266 to assist in retaining the rod 48 in assembly with the nut 260.

The operation of the pump 12 is believed to be readily understandable from the foregoing description of the operation of the pumping system 10. However, briefly, when the piston assembly 47 is in the position illustrated in FIGS. 6A through 6C, the chamber 64 is at a minimum volume, chamber 62 is at maximum volume, chamber 56 is at minimum volume and chamber 54 is at maximum volume. As the piston assembly 47 moves upward in the housing 42 valve 67 closes and production fluid is displaced from chamber 62 through passages 218, 217, check valve 70 and through passage 72, chamber 214, passages 216 and into chamber 54. At the same time, of course, chamber 54 is being reduced in volume as fluid is discharged through passages 172 and 175 through the production fluid conduit 26. The chamber 56 is expanding in volume as driving fluid enters this chamber through the passages 74 in partition 46. The chamber 64 is expanding and drawing production fluid into the pump through passages 32 and 231 with check valve 33 in an open position. As the piston assembly 47 reaches the upper limit of its stroke it is cushioned by the projection 150 entering the cushion chamber 154 whereupon a substantially throttled flow of fluid through passage 155 is permitted to control the rate of deceleration of the piston assembly 47 as it moves toward the head member 44.

When the power transfer apparatus 40 has reached the limit of its stroke to displace driving fluid from chamber 100 and begins to displace fluid from chamber 98 the piston assembly 47 commences a downward stroke, viewing FIGS. 6A through 6C whereby check valve 33 will close to prevent flow of production fluid from chamber 64 through the passages 231 and 32. However, as chamber 64 is decreasing in volume chamber 62 is increasing in volume and fluid will transfer from chamber 64 to chamber 62 through passages 220, 222, 217 and 218. The substantial pressure from the standing column of production fluid in the production conduit 26 as well as the pressure buildup provided by the pressure relief valve 104 will cause check valve 70 to remain closed as fluid in conduit 26 returns to chamber 54 and urges the piston assembly 47 downwardly.

Figure 9:
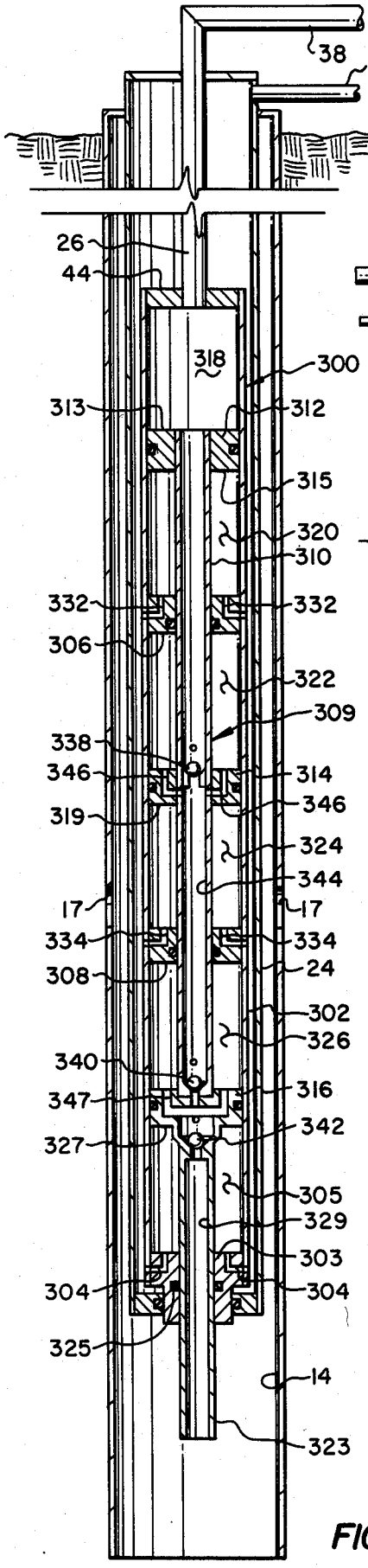
FIG. 9 is a schematic diagram of one alternate embodiment of the downhole pump.

Referring now to FIG. 9, an alternate embodiment of a pump in accordance with the present invention is illustrated and generally designated by the numeral 300. The pump 300 is adapted to be disposed in the driving fluid conduit 24 and includes a generally tubular housing 302 having a bottom head member 303 which is adapted to be seated in the end cap 28 of the driving fluid conduit. Passages 304 formed in the head member 303 open into a chamber 305 within the interior of housing 302 and are in communication with the interior of the conduit 24. The housing 302 also includes an upper head member 44 and two spaced apart partitions 306 and 308. An elongated piston assembly 309 is disposed in the tubular housing 302 and includes a tubular piston rod 310 extending through the partitions 306 and 308 in sliding and substantially fluid sealing relationship thereto.

The piston assembly 309 includes spaced apart pistons 312, 314 and 316 secured to the tubular rod 310 and dividing the housing 302 into respective fluid chambers 318, 320, 322, 324, 326 and 305. The chambers 320 and 324 are also operable to be in communication with the interior of the driving fluid conduit 24 through respective passages 332 formed in the partition 306 and passages 334 formed in the partition 308. The chambers 322 and 326 are operable to be in communication with the wellbore 14 through a fluid draft tube 323 extending downward from piston 316 through a bore in head member 303 in slidable sealed relationship thereto. Suitable seal means 325 is provided in the head member 303 as shown. Check valves 338, 340 and 342 are interposed in passages means in the piston assembly 309 and draft tube 323 including an elongated passage 344 formed in the piston rod 310 and a passage 329 in tube 323.

In response to a downstroke of the piston assembly 309 fluid is transferred from the wellbore 14 to chambers 326 and 322 as the check valves 338 and 340 are unseated to allow fluid to flow into the respective chambers. Suitable passages 346 are formed in the piston 314 and are in communication with the passage 344 for conducting production fluid into and out of chamber 322 and passage means 347 communicates the chamber 326 with the draft tube 323 and the passage 344 by way of check valves 342 and 340, respectively. Check valve 338 remains closed under the urging of production fluid flowing from conduit 26 back into chamber 318 and passage 344 above the check valve 338. Both conduits 26 and 24 are suitably connected to the power transfer apparatus 40 (not shown in FIG. 9) in the same manner as the pump 12. Accordingly, during a downstroke of the piston assembly 309 production fluid flowing back into chamber 318 acts on the upper transverse face 313 of piston 312 but is blocked from flowing into chambers 322 or 326 by the check valve 338. Accordingly, the chambers 322 and 326 are being filled with a fresh charge of production fluid during downstroke movement of the piston assembly 309.

When the piston assembly 309 reaches the lower limit of its downstroke driving fluid acting on the bottom faces 315, 319, and 327 of respective pistons 312, 314 and 316 urges the piston assembly 309 in the opposite direction, check valve 342 closes but check valves 338 and 340 are unseated to allow production fluid to flow from chambers 326 and 322 through respective passages 347 and 346 into and upward through passage 344 and through chamber 318 into the production fluid conduit 26. Since the total effective piston area of the piston assembly 309 exposed to driving fluid acting on the lower faces of pistons 312, 314 and 316 exceeds the pressure force acting on the upper face 313 of piston 312 due to the fluid column in the conduit 26, the piston assembly 309 is normally biased in its upward limit position by the standing column of fluid in the conduit 24. The general operation of the pump 300 is substantially like that of the pump 12 and a further detailed description of the operation of the pump 300 in conjunction with the power transfer apparatus 40 is not believed to be necessary to an understanding of the invention.

The pump 300 is typically used in wells with production fluid of high liquid content or very low entrained gases. The pump 300 is also adapted to operate at very low pressures in the wellbore 14 due to the presence of a relatively short standing column of production fluid in the wellbore since the only pressure requirement to operate the pump is that required to unseat the check valves 340 and 342 during pump downstroke.

Figure 10:
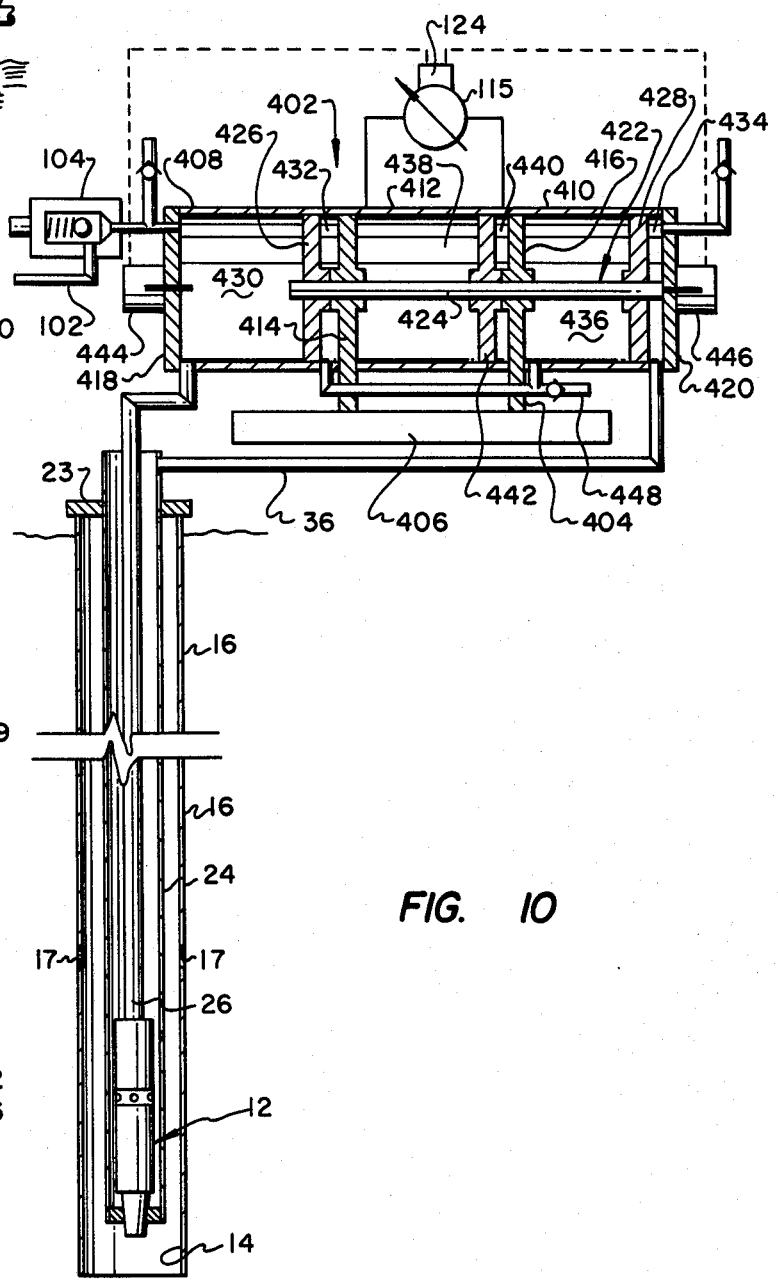
FIG. 10 is a schematic diagram of one alternate embodiment of a power transfer apparatus for the well pump system.

Referring now to FIG. 10 another embodiment of a hydraulically operated pump system in accordance with the present invention is illustrated and generally designated by the numeral 400. The pump system 400 includes a downhole pump 12 disposed in well bore 14 within the driving fluid conduit 24 and is connected to the lower end of production fluid conduit 26. The pump system 400 includes a modified power transfer apparatus, generally designated by the numeral 402 which comprises a frame 404 mounted on a suitable base structure 406 and adapted to form horizontally opposed cylinders 408 and 410 between which an intermediate cylinder 412 is also formed. The cylinder 412 includes opposed head members 414 and 416 which also delimit adjacent ends of the cylinders 408 and 410. The cylinder 408 includes an outer head member 418 and the cylinder 410 includes an outer head member 420. The power transfer apparatus 402 includes a reciprocating piston assembly, generally designated by the numeral 422, and comprising a piston rod 424 reciprocably supported by the frame 404 and extending through the head members 414 and 416. The piston rod 424 is secured to pistons 426 and 428 disposed in the respective cylinders 408 and 410. The piston 426 divides the cylinder 408 into opposed fluid chambers 430 and 432 and the piston 428 divides the cylinder 410 into opposed chambers 434 and 436. The chamber 430 is in communication with the production fluid conduit 26 for receiving production fluid from the pump 12 and the chamber 434 is in communication with the driving fluid conduit 24 for oscillating a column of driving fluid between the cylinder 410 and the pump 12.

The power transfer apparatus 402 also includes the reversible pump 115 which is operably connected to opposed chambers 438 and 440 formed in the cylinder 412 by a driving piston 442 secured to the rod 424. The pump 115 is provided with a controller 124 which is adapted to receive signals for reversing the direction of flow of fluid from the pump in response to actuation of position sensors 444 and 446 disposed on the respective head members 418 and 420 and adapted to sense the position of the piston assembly 422 as the assembly approaches the respective head members.

The power transfer apparatus 402 is also characterized by the provision of pressurized inert fluid through a conduit 448 from a suitable source, not shown, to be introduced into the chambers 432 and 436, respectively. The chambers 432 and 436 may be suitably pressurized with an inert fluid such as nitrogen to prevent any leakage flow of production fluid from the chamber 430 into the chamber 432 or leakage flow of driving fluid from the chamber 434 into the chamber 436. Since the chambers 432 and 436 are in communication with each other through conduit 448, the inert fluid charge in one chamber is merely transferred to the other chamber during reciprocation of the piston assembly 422, resulting in virtually no work consumption.

The power transfer apparatus 402 is operable to reciprocate the piston assembly 47 of pump 12 in the same manner as the power transfer apparatus 40. However, in response to reciprocation of the piston assembly 422 under the urging of hydraulic fluid oscillated between the chambers 438 and 440 by the pump 115, during a stroke of the piston assembly 422 to the right, viewing FIG. 10, driving fluid is displaced from the chamber 434 into the conduit 24 and production fluid is displaced from the pump 12 through the conduit 26 into the chamber 430 and through minimum pressure valve 104 to the production fluid delivery conduit 102. As the piston assembly 422 reaches a predetermined stroke limit on approaching the cylinder head 420, the sensor 446 will cause controller 124 to reverse the direction of flow of fluid through the pump 115 to drive the piston assembly 422 in the opposite direction, that is to the left, viewing FIG. 10, whereupon production fluid will be displaced from the chamber 430 into the conduit 26 to move the pump 12 through a delivery chamber filling stroke as previously described. During movement of the piston assembly 422 to the left, viewing FIG. 10, driving fluid is displaced from the pump 12 and into the cylinder chamber 434. Of course, as the piston assembly 422 approaches the cylinder head 418, the sensor 444 is operable to effect operation of the pump controller 124 to again reverse the direction of fluid flow from the pump 115 to reverse the direction of movement of the piston assembly. The inert fluid, such as gaseous nitrogen, in the chambers 432 and 436 oscillates between these chambers and is maintained at a predetermined pressure to prevent leakage flow of production and/or driving fluid into the respective chambers 432 and 436. Accordingly, the power transfer apparatus 402 provides a unique pump driving device which is relatively compact. Those skilled in the art will appreciate that the power transfer apparatus 40 and 402 may also be utilized to pump fluids for other uses.

Figure 11:
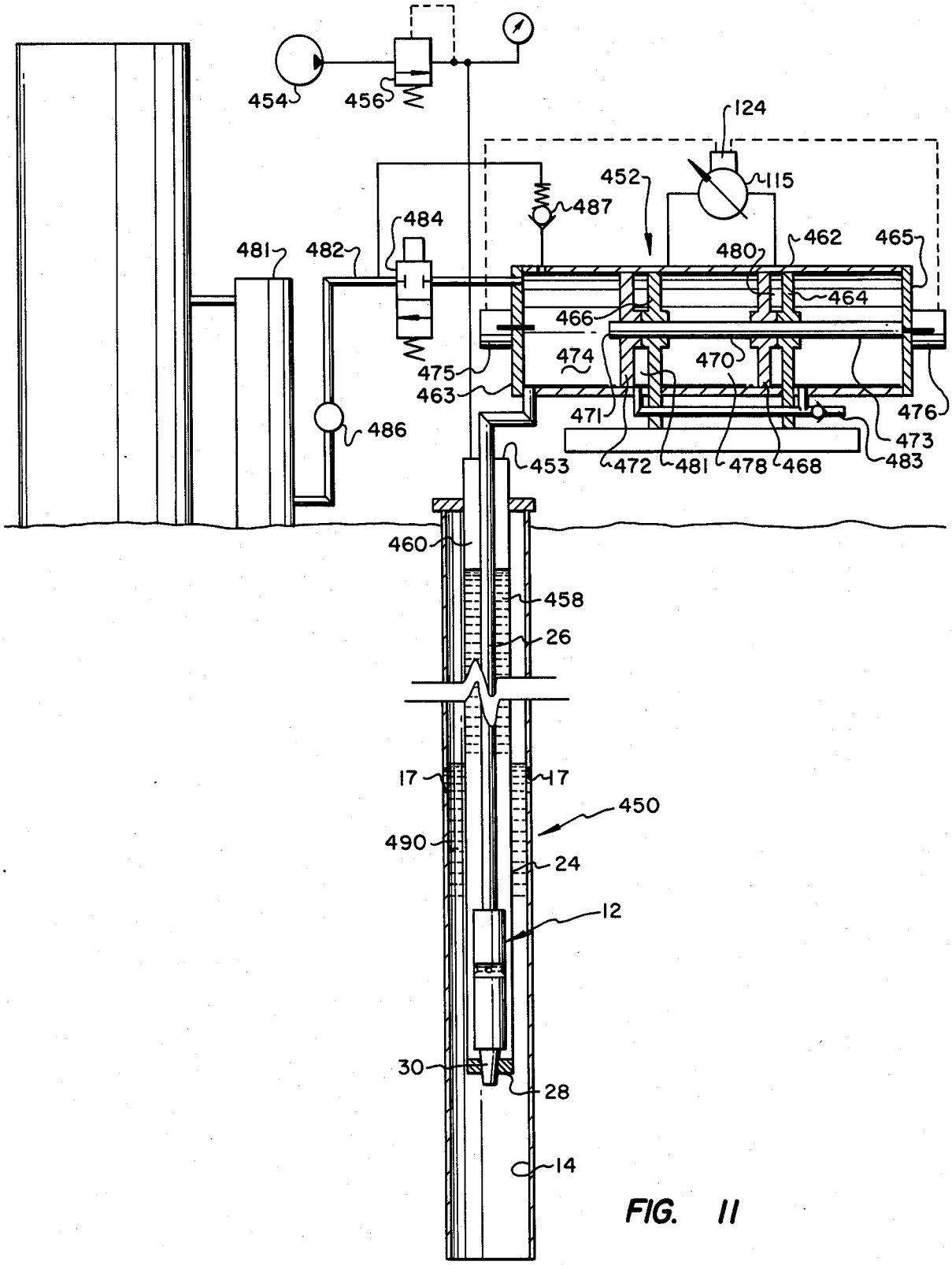
FIG. 11 is a schematic diagram of one alternate embodiment of the well pump system.

Referring now to FIG. 11 there is illustrated yet another embodiment of a hydraulic well pumping system, generally designated by the numeral 450. The pump system 450 includes a downhole pump 12 disposed in a driving fluid conduit 24 and seated in sealed engagement with the end cap 28. The pump 12 is also connected at its upper end to a production fluid conduit 26 which is in communication with a power transfer apparatus 452. The conduit 24 is closed at its top end 453 and is in communication with a source of pressure gas such as nitrogen by way of a pump 454 and a pressure regulator 456. The conduit 24 is substantially filled with a driving fluid 458, such as water, to a predetermined level and a gas chamber 460, formed at the top of the driving fluid conduit 24, is charged with pressure gas from the pump source 454 at a predetermined pressure as determined by the regulator 456. Accordingly, a substantially constant bias force is acting on the piston assembly 47 of the pump 12 urging it in an upward direction to displace production fluid through the conduit 26 to the power transfer apparatus 452.

The power transfer apparatus 452 includes a cylinder 462 having internal partitions 464 and 466, opposed end heads 463 and 465 and a hydraulic driving piston 468 disposed in the cylinder between the partitions 464 and 466. The piston 468 is connected to a rod 470 which extends through the partition 466 and is secured to a piston 472 forming a production fluid displacement chamber 474 in cylinder 462 between the piston and the head 463. The piston rod 470 includes opposed end portions 471 and 473 which are engageable with position sensors 475 and 476, respectively. The position sensors 475 and 476 are operable to control the reversible hydraulic pump 115 by way of its controller 124 to deliver hydraulic fluid alternately to opposed cylinder chambers 478 and 480 formed on opposite sides of the piston 468. The production fluid chamber 474 is in communication with a delivery tank 481 by way of a delivery conduit 482 and a power operated valve 484. The valve 484 may be characterized as a normally open valve which is solenoid operated, for example, to be in a closed position. The valve 484 is adapted to be interposed in a control circuit including the position sensors 475 and 476 whereby the valve will be opened during a phase of the operating cycle of the power transfer apparatus 452 wherein the pistons 468 and 472 are moving to the right, viewing FIG. 11, to increase the volume of chamber 474. During this phase of operation of the pump system 450, the pressure exerted on the pump 12 by the column of driving fluid 458 and the pressure of gas in the chamber 460 will stroke the pump 12 through a delivery stroke cycle to fill the chamber 474 and to cause fluid to flow through the delivery line 482 to the tank 481. When the piston rod 470 engages the position sensor 476 the valve 484 may be actuated to a closed position so that as the pistons 468 and 472 move toward the left, viewing FIG. 11, to displace fluid from the chamber 474 production fluid is returned through the conduit 26 to the pump 12 to cause the pump to move through a production fluid intake stroke to fill the chamber 62. When the piston rod end 471 engages the position sensor 475, the valve 484 may be actuated to the open position preparatory to another fluid delivery cycle. Since the movement of the pump piston assembly 47 through a production fluid delivery stroke is independent of the movement of the pistons 468 and 472 to increase the volume of the chamber 474, it may be desirable to control the actuation of the valve 484 utilizing a flow sensing switch 486 which, upon sensing a predetermined quantity of fluid flow, or a change in fluid flow through conduit 482 indicating a completion of a delivery cycle of the pump 12, will actuate the valve 484 to move to a closed position. A pressure relief valve 487 bypasses the valve 484 to prevent damage to the pump 12 in the event that the timing of the closure of the valve 484 should fail to coincide with the completion of a delivery stroke of the pump 12.

One advantage of the pumping system 450 is that the amount of production fluid 490 standing in the wellbore 14 together with the pressure in the chamber 460 and the height of the column of driving fluid 458 may be correlated to provide for a production fluid delivery stroke of the pump 12. Accordingly, the pressure in the chamber 460 may be set such that a pump delivery stroke will occur only when a sufficient column height of fluid 490 in the wellbore 14 is present to provide the additional pressure force acting on the piston surface 53 to move the piston assembly 47 through a delivery stroke. In this way the pump system 450 may be operated to prevent overpumping a well and possibly damaging the subterranean formation characteristics. An advantage of the pumping system 450 is that the height of the column of driving fluid 458 may be selectively adjusted as may the pressure in the accumulator chamber 460 in accordance with the pump working pressure requirements.

Referring now to FIG. 12 another embodiment of a downhole pump in accordance with the present invention is illustrated in somewhat schematic form and generally designated by the numeral 500. The pump 500 is shown disposed in the driving fluid conduit 24 within wellbore 14 and comprises an elongated tubular housing 502 having a lower head member 504 of a configuration similar to the head member 303 adapted to be seated in sealing engagement with the end cap 28. The head member 504 supports an elongated foraminous tubular sand screen member 506 extending downward from the head member 504 into the wellbore 14. The opposite end of the housing 502 includes a head portion 508 having a transverse shoulder 510. The shoulder 510 is engageable with a cooperating shoulder 512 formed on a coupling member 514 having a depending tapered portion 516 adapted to be seated in a tapered bore 518 formed in a housing partition 520. An elongated passage 522 extends through the coupling member 514 and is in communication with the interior of the production fluid conduit 26. The coupling member 514 is suitably threadedly connected to the conduit 26 as indicated in FIG. 12.

The housing 502 is divided into opposed production fluid transfer and delivery chambers 526 and 528 by an interior fixed partition 530. The delivery chamber 528 is further defined by a piston 532 slidably disposed in the interior bore of the housing 502. An expansible driving fluid chamber 534 is formed in the housing 502 between the piston 532 and head member 504. Driving fluid is communicated to the chamber 534 through passages 536 formed in the head member 504 and opening into the interior of the conduit 24. A tubular rod 538 extends upward from the piston 532 and through a close fitting bore 531 in the partition 530 and into the chamber 526. The piston 532 includes a depending tubular rod portion 540 having a removable screen scraping piston head 542 formed on the lower distal end thereof. A passage 543 in the rod 540 opens into the chamber 528 through a passage 544 interposed between check valves 546 and 548. The arrangement of the check valves 546 and 548 is substantially like that of the check valves 70 and 67, respectively, in the piston 52 of pump 12 whereby a minimum volume of fluid remains in the chamber 528 after displacement of fluid therefrom through a passage 539 formed in the rod 538.

The pump 500 is particularly adapted for use in low volume production wells. Driving fluid in the conduit 24 enters the chamber 534 through the passages 536 and acts on piston face 533 to urge the piston 532 on an upward production fluid delivery stroke wherein fluid is displaced from the chamber 528 through passage 544, unseating check valve 546 and delivering fluid through passage 539 and chamber 526 into the production fluid conduit 26. The pump 500 is adapted to be used with the power transfer apparatus described in conjunction with pump systems illustrated in FIGS. 1, 10 or 11. Accordingly, in response to returning production fluid through the conduit 26 into the chamber 526 a pressure force acting on the rod end face 541 will urge the piston 532 downward maintaining the check valve 546 closed and allowing the check valve 548 to open to admit production fluid from the wellbore through passages 543 and 544 into the chamber 528. During reciprocation of the piston 532 a pumping action created by the rod 540 and the scraper head 542 maintains the sand screen 506 free of debris and said accumulation thereon.

The arrangement of the coupling member 514 is similar to that of the pump 12 whereby, upon lifting the pump 500 with the production conduit 26, the coupling member 514 will move out of sealing engagement with the bore 518 into engagement with the shoulder 512 to allow fluid to flow through ports 505 formed in the housing 502 so that the pump 500 may be pulled from the conduit 24 in a "dry" condition. As with the pump 12 the area of an upward facing transverse end face 509 is designed to be greater than the opposing face area of the lower transverse end face 511 formed on the head 504 and exposed to the pressure fluid in the conduit 24. In this way the standing column of pump driving fluid acts with a resultant force on the pump 500 to maintain the pump seated in engagement with the end cap 28 during operation of the pump. The hold down force exerted on the pump 500 if used in conjunction with the system of FIG. 11 may be accentuated by the amount of fluid pressure in the accumulator chamber 460. Accordingly, a pump such as the pumps 12, 300 or 500, if used in an accumulator type system for the driving fluid, may be unseated somewhat easier than the other pump system configurations since the portion of the holddown force controlled by pressure gas in the chamber 460 may be reduced before unseating the pump from the conduit end cap 28.

Referring now to FIG. 13 another pumping system in accordance with the present invention is illustrated and generally designated by the numeral 600. The scale of drawing FIG. 13 is modified to show details of the downhole pump as well as the wellhead apparatus. The pump system 600 is a modified mechanically actuated and hydraulically actuated system and employs a downhole pump 602 disposed in a production fluid conduit 604 having an end cap 606 at the lower end thereof and constructed similar to the end cap 28 of the driving fluid conduit 24 for the pumping system embodiments previously discussed. The conduit 604 extends to a wellhead 608 and is in communication with a production fluid delivery line 610. A conventional polish rod stuffing box 612 is mounted at the upper end of the conduit 604. The wellbore 14 may be cased by a suitable casing 611 which extends to the wellhead 608 in a conventional manner.

The pump 602 includes an elongated cylindrical tubular housing 616 having an upper head portion 618 and a lower head portion 620 which is provided with a conically tapered portion 622 adapted to be seated in sealing engagement with the end cap 606 in a manner similar to the construction of the pump 12, for example. The pump housing 616 is divided into upper and lower chambers 624 and 626 by a piston assembly 628 having an upwardly extending tubular rod portion 630 which extends through the head member 618 and is coupled to an elongated pump rod 632, commonly known as a sucker rod, by a tubular coupling member 634. The coupling member 634 is provided with a passage 636 which opens into the interior of the conduit 604 from a passage 648 formed in the piston rod 630. The pump rod 632 is of conventional construction and extends upward through the stuffing box 612 and is connected to a walking beam 640 of a conventional well pumping mechanism 642.

The piston 628 also includes a downwardly extending tubular rod portion 644 providing a passage 646 which is in communication with a passage 648 in the piston by way of a check valve 650. A second check valve 652 provides for one way flow between passages 648 and 638. The construction of the piston 628, in regard to the arrangement of the check valves 650, 652 and the passage 648, is similar to the corresponding structure of the pumps 12 and 500, for example.

Fluid in the interior of conduit 604 is admitted to the pump chamber 626 by way of passages 656 formed in the head 620. In the position of the piston 628 illustrated in FIG. 13 it will be assumed that the chamber 624 has been filled with production fluid from the wellbore 14 by way of passages 646 and 648 during unseating of the check valve 650 which would occur during a downstroke of the piston 628 from a minimum volume condition of the chamber 624 to the position of the pump illustrated in the drawing figure. When the pump actuation mechanism 642 exerts an upward pulling force on the rod 632, the piston 628 is lifted by the rod 630 to displace fluid from chamber 624 through passage 648 unseating check valve 652 to cause fluid to flow through passage 638 and passage 636 into the interior of the conduit 604. The net force required to displace a quantity of production fluid from the chamber 624 is assisted by the pressure head of the column of fluid standing in the conduit 604 which is exerted on piston face 629 to assist in displacing fluid from the chamber 624 into the conduit 604.

When the pumping unit 642 actuates the rod string 632 to move the piston 628 from the lowermost position shown in FIG. 13 upwardly, fluid is displaced from chamber 624, however, production fluid is also flowing into chamber 626 which has a volume equal to chamber 624. Accordingly, during a pump upstroke there is no net delivery of fluid to and through the delivery conduit 610. However, the fluid acting on the piston face 629 assists in lifting the rod string 632. When the piston 628 has reached the upper limit of its upstroke a shoulder 631 is operable to enter a dash pot chamber 619 formed in the head member 618 to cushion the upper stroke limit position of the piston assembly. Accordingly, the pumping unit 642 is required to lift only the weight of the rod string 632 and overcome frictional resistance of the fluid column and mechanical friction in the pump 602 during an upstroke.

During downstroke of the rod string 632 some contraction of the rod string will occur as a result of the reduction in tensile stress and subsequently some compression of the rod string will occur as downstroke commences. However, the weight of the rod string will operate to displace production fluid out of the chamber 626 into the interior of the conduit 604. The check valve 652 will be maintained in a closed position under the urging of the pressure of fluid in the interior of the conduit 604 and the passage 638, and the check valve 650 will open to admit a fresh charge of production fluid from the wellbore 14 into the chamber 624. Conventional sucker rod bumpers or centralizers 633 may be interposed along the rod string 632 to alleviate the tendency of the rod string to buckle under column loading.

The pump system 600 is particularly advantageous for relatively deep wells wherein the weight of the rod string 632, for example, becomes a limiting factor in the ability to operate a downhole pump. By splitting the work required of the pumping unit 642 to occur on both the upstroke and downstroke many of the detrimental effects of rod actuated pumps, particularly for operating in deep wells, may be overcome by the pump system 600. The downhole pump 602 may share several common parts with the other pump embodiments described herein including the arrangement of the check valves 650 and 652 in the piston 628, the lower head member 620 and the lower rod or draft tube 644. The draft tube 644 and the piston rod 630 are preferably of the same outer diameter. The pump 602 is maintained in seating engagement with the end cap 606 by the pressure force of production fluid in the conduit 604 exerted on the upper transverse end face 621.

A modified version of the rod actuated pump is illustrated in FIG. 14 and generally designated by the numeral 700. The pump 700 is adapted to be seated in the conduit 604 in the same manner as the pump 602 and comprises a cylindrical housing 704 having a lower head member 706 which is adapted to be seated in sealed engagement with the end cap 606 of the conduit 604. The head member 706 includes a fluid inlet passage 708 in which is interposed a check valve 710 for admitting fluid into an interior chamber 712 formed by the housing 704 and a reciprocable piston 714 interposed in the housing bore 705. A second chamber 716 is formed between the piston 714 and an upper head member 718 which is virtually identical to the head member 618 of the pump 602.

The piston 714 is connected to a tubular piston rod 720 which is adapted at its upper end to be coupled to the coupling member 634 and the rod string 632. The piston 714 is adapted to have the anti-gas lock check valve arrangement comprising check valves 724 and 726 interposed therein for admitting fluid from the chamber 712 to the chamber 716 during a downstroke of the piston and providing for displacement of fluid from the chamber 716 up through the passage 721 in the rod 720 and into the interior of the conduit 604 through the coupling 634.

During an upstroke of the piston 714 fluid is drawn from the wellbore 14 into the chamber 712 through the check valve 710 and, assuming that the chamber 716 is full of fluid, the check valve 726 is unseated to displace fluid from the chamber 716 into the interior of the conduit 604 through the aforementioned passages 721 and the passage 636 in the coupling 634. During a piston upstroke the check valve 724 is maintained closed. At the top of the upstroke of piston 714 the check valve 726 closes and, thanks to the minimum volume of the passages 727 between the valves 724 and 726 an insignificant amount of production fluid is trapped in chamber 716 and subject to expansion of entrained gases. As a piston downstroke commences the check valves 710 and 726 close and check valve 724 opens to transfer fluid from the chamber 712 to the chamber 716. The pump 700 is biased in its seated position in engagement with end cap 606 by the pressure of fluid in conduit 604 acting on the transverse end face 719 of head member 718.

Figure 15:
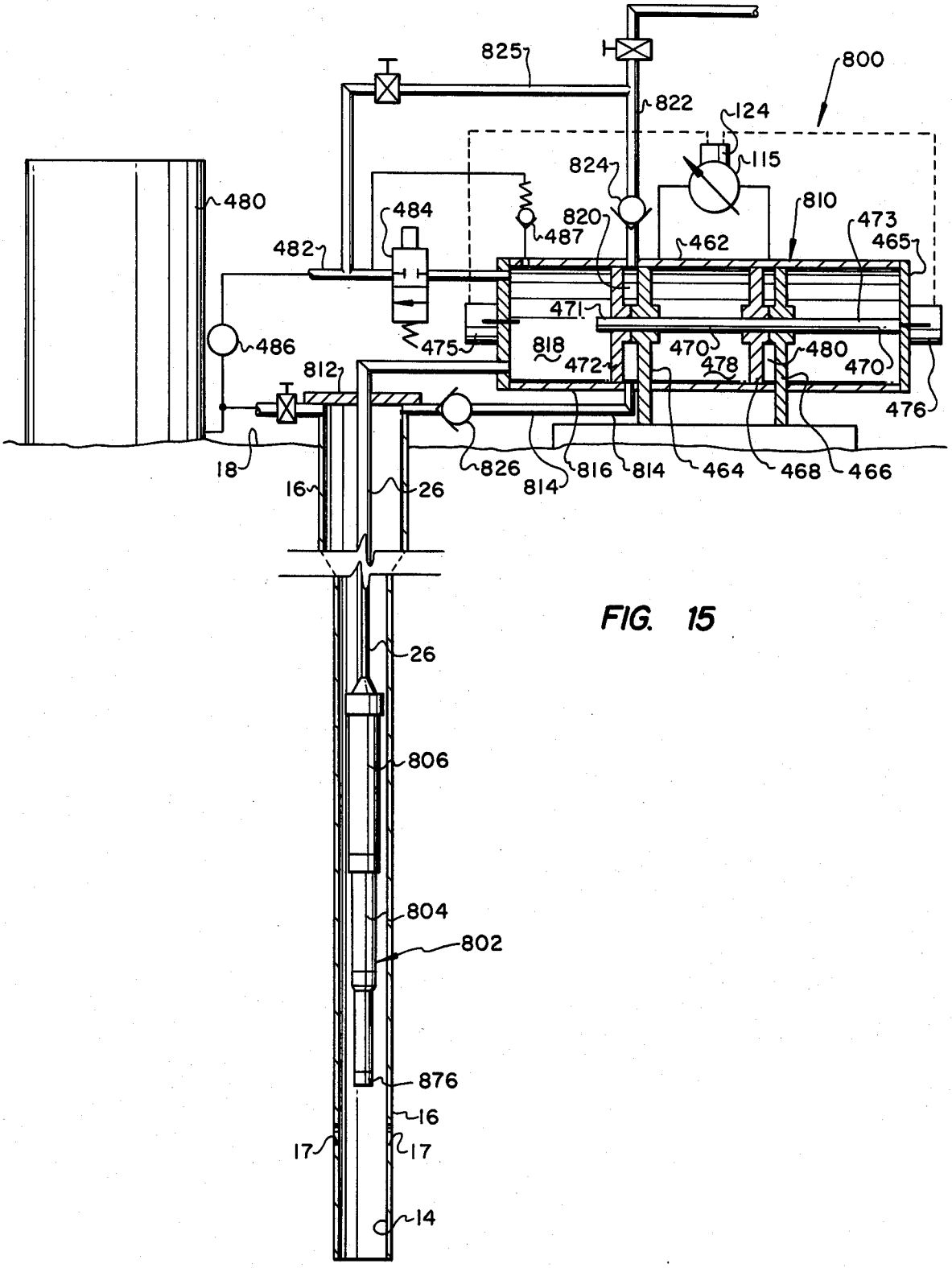
FIG. 15 is a schematic diagram of a third alternate embodiment of a well pump system in accordance with the invention.

Referring now to FIG. 15 another embodiment of a well pumping system in accordance with the invention is illustrated and generally designated by the numeral 800. The pumping system 800 is adapted to be operated in conjunction with the wellbore 14 also having the casing 16 and suitable perforations 17 for admitting production fluid into the wellbore from the producing formation. The pump system 800 includes a downhole pump, generally designated by the numeral 802 which is adapted to be disposed in the wellbore 14 at a point above the bottom to minimize the ingestion of sand or other debris into the pump inlet. The pump 802 includes an elongated tubular cylinder member 804 which is connected to a cylinder 806 comprising a gas charged accumulator structure which will be described in further detail herein. The upper end of the cylinder 806 is suitably connected to the production fluid delivery 26 which extends to the surface 18 and is connected to a power transfer unit 810. In the arrangement of the pumping system 800 the casing 16 extends to the surface 18, is closed by a head portion 812 and is also in communication with a gas delivery conduit 814 leading to the power transfer unit 810.

As will be appreciated further herein, upon reading the detailed description of the pump 802, the pumping system 800 does not require a driving fluid conduit within the wellbore itself but effectively reciprocates the pump 802 by oscillation of production fluid in the conduit 26 in essentially the same manner as the pumping system illustrated in FIG. 11. In fact, the power transfer unit 810 is similar in many respects to the power transfer unit 452 and is characterized by a cylindrical housing 462 having internal partitions 464 and 466 and a hydraulically operated driving piston 468 reciprocably disposed in the cylinder 462 to form the chambers 478 and 480. A piston rod 470 extends through the spaced partitions 464 and 466 and is connected to a piston 472 disposed in a modified cylinder member 816. The cylinder 816 is divided into opposed chambers 818 and 820 which are, respectively, in communication with the conduit 26 and the gas delivery conduit 814.

The chamber 820 is also in communication with a gas discharge conduit 822 and one way compressor type check valves 824 and 826 are interposed in the conduits 822 and 814, respectively, to provide for delivery of gas from the wellbore 14 into and through the power transfer cylinder chamber 820 in response to reciprocation of the pistons 468 and 472. The power transfer unit 810 also includes the position sensors 475 and 476 which are operable to reverse the delivery of hydraulic fluid from the pump 115 to effect reciprocation of the pistons 468 and 472 by way of their interconnecting piston rod 470. The pumping system 800 also includes a solenoid operated valve 484 disposed in a production fluid delivery line 482 for delivery of well fluid to a storage tank 481 by way of a flow sensing switch 486. A gas bypass line 825 is interconnected between the delivery conduit 822 and the well fluid delivery conduit 482 to selectively discharge gas to the tank 481 with the liquid well fluid. Accordingly, the power transfer unit 810 is not only operable to effect oscillation of a portion of the production fluid delivered to the chamber 818 through conduit 26 to effect driving of the pump 802 but also provides for evacuating or reducing the pressure in the wellbore 14 to enhance production of well fluid and draw off any gas produced in the well. Operation of the power transfer unit 810 thereby effectively scavenges the wellbore 14 to a selected reduced pressure and compresses gas delivered to the chamber 820 for delivery to a suitable end use. The operation of the power transfer unit 810 being similar to the power transfer unit 452 is not believed to require any further detailed explanation.

Figure 16A:
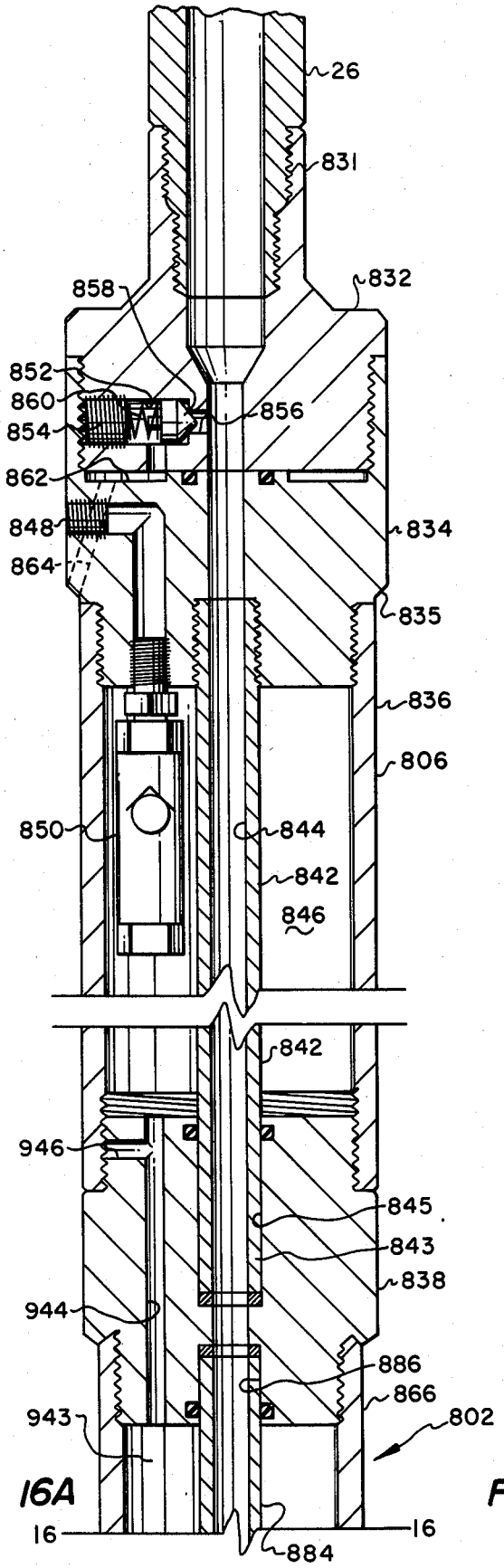
FIG. 16A is a longitudinal central section view of a portion of a third alternate embodiment of a downhole pump for use with the system of FIG. 15.
Figure 16B:
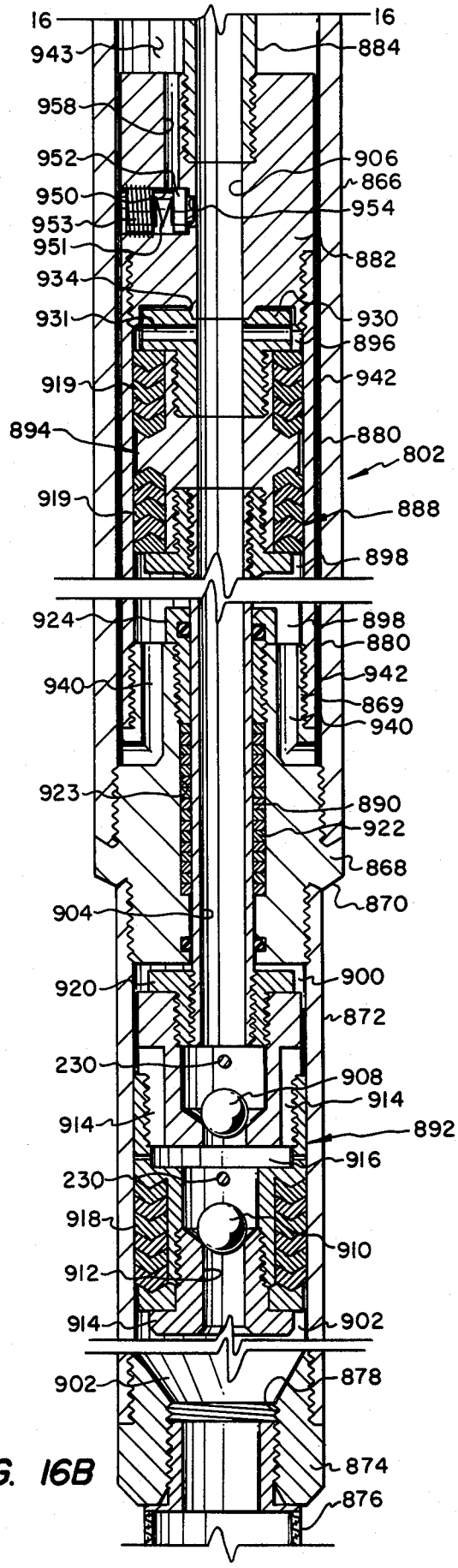
FIG. 16B is a continuation of FIG. 16A from the line 16—16.

A primary difference between the pump system 800 and the pump system 450 resides in the provision of a gas charged accumulator within the cylinder 806 instead of within the driving fluid conduit 24, which conduit has in fact been eliminated in the system illustrated in FIG. 15. Referring now to FIGS. 16A and 16B, the downhole pump 802 is illustrated in longitudinal central section view. Referring to FIG. 16A, in particular, the lower end of the production fluid delivery conduit 26 has a modified externally threaded portion 831 which is threadedly connected to a head member 832 of the cylinder 806. An intermediate head portion 834 is threadedly connected to the head 832 and to an elongated cylindrical tube 836. The lower end of the tube 836 is threadedly coupled to an intermediate connector member 838 forming the lower head of the cylinder 806. An elongated central conduit section 842 extends through the cylinder 806 and provides part of a passage 844 for conducting production fluid from the pump cylinder 804 to the production fluid conduit 26. The cylinder 806 may be disconnected from the pump cylinder 804, including the connector member 838, for handling the pump when inserting or withdrawing the pump with respect to the wellbore 14. In this regard, the conduit 842 includes a lower end portion 843 extending into a bore 845 formed in the connector member 838.

Referring further to FIG. 16A, in particular, the cylinder 806, together with the conduit 842, forms an annular chamber 846 between the head member 834 and the connector 838. The chamber 846 is adapted to be charged with pressure gas such as nitrogen through a charging port 848 which is in communication with a check valve 850 to provide for charging the chamber 846 with pressure gas before insertion of the pump 802 into a wellbore. The head member 832 is also provided with a transverse bore 852 closed by a plug 854 and opening into the passage 844 through a port 856. A spring biased pressure relief valve closure member 858 is disposed in the bore 852 and is biased to close the port 856 by a spring 860. The bore 852 is in communication with a fluid discharge passage 862, 864 leading to the exterior of the pump 802 for discharging fluid from the production delivery fluid conduit when it is desired to pull the conduit 26 from the wellbore in a "dry" condition. This may be accomplished by pressurizing the conduit 26 with an inert gas to drive well fluids out of the interior of the conduit through the valve 858. The head member 834 is of slightly larger diameter than the tube 836 to provide a transverse shoulder 835 which may be utilized to support the accumulator cylinder 806 during operations to insert and/or withdrawal the pump with respect to a wellbore.

Referring now primarily to FIG. 16B, the pump cylinder 804 comprises an elongated outer tubular member 866 which is threadedly connected to the member 838 at its upper end and is also threadedly connected to a partition member 868 at its lower end. The partition member 868 is also formed with a transverse shoulder 870 for supporting the pump 802 in slips or other suitable means during preparation for insertion of the pump 802 with respect to a wellbore. The lower end of the partition member 868 is threadedly connected to a reduced diameter tubular housing member 872 which extends to and is threadedly coupled to a lower end cap 874. The end cap 874 may be suitably connected to a well fluid inlet filter screen structure 876 for filtering sand and other debris out of well fluids entering the interior of the pump 802 through an inlet passage 878.

Referring further to FIG. 16B, the cylinder 804 includes an inner housing structure comprising an elongated cylinder member 880 which is connected at its lower end to a reduced diameter boss portion 869 of the partition 868 and is connected at its upper end to a head part 882. The head part 882 is connected to a tubular conduit 884 which is insertable at its upper end into a bore 886 in the connector member 838. The pump 802 is similar in some respects to the pump 12 illustrated in FIGS. 6A, 6B and 6C in that an elongated piston assembly 888 is slidably disposed in the cylinder 880 and the cylinder member 872 and is characterized by a tubular piston rod 890 which is suitably connected at its opposite ends to piston 892 and 894, respectively. The piston 894 is slidably disposed in the cylinder member 880 and divides the cylinder member into upper and lower chambers 896 and 898, respectively. In a similar manner the piston assembly 892 forms, in part, a chamber 900 and a chamber 902 in the cylinder 872. The chamber 902 is in communication with the fluid inlet passage 878 and the chamber 900 is in communication with an elongated passage 904 in the piston rod 890, which passage is in communication with the chamber and a passage 906 extending up through the head member 882, the conduit 884 and the connector member 838 to be in communication with the passage 844 and the production fluid conduit 26.

The piston assembly 892 is adapted to include closely spaced ball type one way check valves 908 and 910, respectively. The valve 910 is operable to seat over a passage 912 formed in a piston packing retaining nut 914. The passage 912 is in communication with the chamber 902 for transferring well fluid from that chamber to the chamber 900 through passages 914 and 916 during a downstroke of the piston assembly 888. In like manner, the check valve 908 is operable to communicate the chamber 900 with the passage 906 in the piston rod 890 by way of the passages 914 and 916 formed in the piston 892. Suitable piston ring seals or packing 918 is provided on the piston 892 and a nut member 920 is operable to secure the piston 892 to the piston rod 904. The rod 904 is suitably sealed by conventional packing or seals 922 interposed in a bore 923 formed in the partition member 868 to seal the chamber 900 from communication with the chamber 898. A packing nut 924 is threadedly engaged with the partition 868 to retain the packing 922 therein. The piston 894 is also provided with suitable packing 919 for sealing engagement with the bore wall of the cylinder member 880 to prevent fluid flow between the chambers 896 and 898. The upper end of the piston 894 is provided with a removable upstroke stop member 930 having passage means 931 formed therein for communicating the passage 906 with the chamber 896 even if the stop member is engaged with a flange 934 formed on the head member 882.

Referring still further to FIG. 16B, pump driving fluid is admitted to the chamber 898 for urging the piston 894 in an upward direction, viewing FIG. 16B, by way of passages 940 which are in communication with an annular passage 942 formed between the outer surface of the cylinder member 880 and the inner bore of the cylinder member 866. The passage 942 opens into a liquid reservoir chamber 943 which is in communication with a passage 944 formed in the head member 838. The passage 944 opens into accumulator gas chamber 846. A branch passage 946 opens to the exterior of the connector member 838 for relieving the pressure of gas charged into the chamber 846 upon disconnection of the connector member 838 from the cylinder 806. The head member 882 is provided with a transverse bore 950 in which a spring 951 is retained by a plug 953 and biases a valve closure member 952 to close a port 954. The port 954 opens from the passage 906 into the chamber 943 by way of a passage 958. In the event that it is necessary to replenish the quantity of driving fluid used in the pump 802 the well production fluid may be suitably pressurized to the extent that the valve 952 unseats to admit fluid into the driving fluid chamber 943. Of course, some quantity of driving fluid may be present in the chamber 846 although primarily this chamber is charged with gas to form the gas charged accumulator function and the gas-liquid interface is maintained in chamber 943.

The operation of the pump 802 is believed to be understandable from the foregoing description, however, briefly, the pump 802 is operated by the displacement of production fluid from the conduit 26 into the chamber 896 to act against the upper transverse end face of the piston 894 to displace the piston assembly 888 downward increasing the volume of chamber 900 at which time the valve 910 unseats to allow well fluid to enter expanding chamber 900 from contracting chamber 902 by way of passages 914 and 916. Production fluid in the passage 906 maintains the check valve 908 seated to prevent flow of fluid between the passage 916 and the passage 906. During displacement of the piston assembly 888 downward the chamber 898 is contracting in volume to force driving fluid back into the annular passage 942 at least slightly compressing gas in the chamber 846 depending, of course, on the volume of the chamber.

When the piston assembly 888 reaches the bottom of its stroke and the power transfer unit 810 reverses the direction of movement of the pistons 468 and 472 pressure fluid acting on the lower transverse face of the piston 894 urges the piston assembly 888 upwardly displacing fluid from the chamber 900 into the passage 906 by way of the check valve 908 and drawing a fresh charge of production fluid into the chamber 902, all the while the check valve 910 being in a closed position. The displacement of the chamber 900 is greater than the chamber 818 of power transfer unit 810 and a net amount of well production fluid is displaced through the conduit 482 into the storage tank 481 until the valve 484 is energized to close whereby movement of the piston 472 in the opposite direction to reduce the volume of chamber 818 will again drive the piston assembly 888 in a downward direction as production fluid is oscillated in the conduit 26.

The pump 802 is particularly advantageous in that a well can be completed and pumped without the use of the driving fluid conduit 24 resulting in substantial capital savings. Another advantage of the pump 802 is that the compression of gas in the chamber 846 during each stroke of the pump will result in some heating of the gas which heat will transfer to the working portions of the pump cylinder 804 as well as to the fluid flowing through the passage 844 which will prevent the buildup of undesirable waxes and paraffing in these passages and also assist in the delivery of particularly viscous well fluids through the conduit 26.

Installation of the pump 802 may be carried out from the surface using conventional downhole tool handling techniques. Prior to insertion of the pump 802 into the wellbore 14 the passages 940 and 942 are filled with clean driving fluid such as a refined oil, the cylinders 804 and 806 are coupled together and the chamber 846 is then charged with a quantity of pressure gas at a desired working pressure. The amount of compression of gas in the chamber 846 is, of course, dictated by the displacement of the chamber 898 and the volume of chamber 846. This can be predetermined to minimize the compression of the gas in the accumulator chamber 846 during actuation of the pump. The operation of the power transfer unit 810 is virtually identical to that of the power transfer unit 452 with the exception that the chamber 820 is in communication with the wellbore 14 to reduce the pressure therein and to scavenge any gas for transfer to a discharge line 822.

Although preferred embodiments of the present invention have been described in detail herein those skilled in the art will recognize that various substitutions and modifications may be made to the various components of the invention without departing from the scope and spirit thereof as recited in the appended claims.

What I claim is:

1. A hydraulically operated fluid pumping apparatus for a downhole well pump comprising:

a frame;

first and second opposed cylinder means mounted on said frame, each of said cylinder means including a cylinder bore, first and second piston means disposed in respective ones of said bores and dividing said bores into opposed fluid chamber, respectively, said first and second piston means being interconnected by a common piston rod mounted for reciprocation of said frame, wherein one of said chambers formed by said one bore is connected to a gas delivery conduit for connection to a wellbore for evacuating gas from said wellbore in response to reciprocation of said piston means;

a production fluid delivery conduit for delivering production fluid to one of said chambers formed by one of said bores of one of said cylinder means and a production fluid discharge conduit connected to said one chamber for receiving production fluid from said apparatus; and hydraulic pump means operably connected to opposed hydraulic fluid chambers of the other of said cylinder means for delivering hydraulic fluid to reciprocate said piston means through said hydraulic fluid chambers, respectively, and control means responsive to movement of said piston means to effect flow reversal of fluid from said hydraulic pump means to alternately deliver pressure fluid to said hydraulic fluid chambers to effect reciprocation of said piston means for delivering production fluid to said discharge conduit and said delivery conduit, respectively.

2. A hydraulically operated downhole well pump system for lifting production fluids from a wellbore comprising:

a positive displacement pump adapted to be disposed in said wellbore at a predetermined depth, said pump including an elongated housing, pump piston means disposed in said housing and definfing, in part, a pump production fluid chamber and a pump driving fluid chamber, and valve means for admitting production fluid to said pump production fluid chamber from said wellbore;

a pressure fluid accumulator in flow communication with said driving fluid chamber for providing a fluid pressure force on said driving fluid at a predetermined pressure to effect displacement of driving fluid in said driving fluid chamber;

first conduit means extending between said pump and said wellhead and in fluid flow communication with said pump production fluid chamber for conducting production fluid from said pump;

second conduit means extending in said wellbore and in communication with said driving fluid chamber, and said accumulator includes a chamber in said second conduit means and charged with pressure gas at a predetermined pressure; and means for effecting displacement of production fluid in said first conduit means to cause said pump piston means to reciprocate to displace production fluid from said pump production fluid chamber through said first conduit means to said wellhead.

3. The pump system set forth in claim 2 wherein:

said pump includes a conduit extending through said chamber in said second conduit means and in communication with said first conduit means for delivering production fluid to said first conduit means and in heat exchange relationship with compressed gas in said accumulator chamber to absorb heat of compression of said gas.

4. A positive displacement downhole well pump for pumping production fluid from a well, said pump comprising an elongated cylindrical housing, partition means interposed in said housing, piston means disposed in said housing including an elongated tubular piston rod extending through said partition means in slidable fluid sealing relationship thereto, a first piston connected to said piston rod and dividing a bore in said housing into a driving fluid chamber and a production fluid delivery chamber, means forming a port in said housing opening into said driving fluid chamber for communicating driving fluid to said driving fluid chamber, passage means in said piston means for conducting production fluid to and from said delivery chamber, means for conducting production fluid from the exterior of said housing to said passage means, one way valve means interposed in said passage means in such a way as to permit transfer of production fluid to said delivery chamber and from said delivery chamber to a transfer chamber formed in said housing in response to said piston means being urged through a reciprocal stroke cycle in said housing, and passage means in said housing for conducting production fluid from said transfer chamber to a production fluid conduit connected to said pump.

5. The pump set forth in claim 4 wherein:

said piston rod extends into said transfer chamber and includes a piston face exposed to production fluid in said transfer chamber for urging said piston means to displace driving fluid from said driving fluid chamber.

6. The pump set forth in claim 4 wherein:

said pump includes valve means responsive to said pump being lifted by said production fluid conduit to drain production fluid from said production fluid conduit into said wellbore.

7. The pump set forth in claim 4 wherein:

said one way valve means includes a first one way valve disposed in said piston means and a second one way valve interposed in said passage means between said first one way valve and said production fluid conduit in such a way as to minimize the volume of production fluid in said passage means between said first and second one way valves.

8. The pump set forth in claim 4 wherein:

said pump includes an elongated draft tube extending from said piston means in slidable sealed engagement through a lower head member of said housing, said draft tube including passage means in communication with said passage means in said piston means for conducting production fluid from said wellbore to said delivery chamber.

9. The pump set forth in claim 8 wherein:

said driving fluid chamber is formed in said housing between said lower head member and said piston means.

10. A hydraulically operated downhole well pump system for lifting production fluids from a wellbore comprising:

a positive displacement pump adapted to be disposed in said wellbore at a predetermined depth, said pump including an elongated housing including a first partition interposed in cylinder bore means formed in said housing and forming a production fluid transfer chamber; pump piston means disposed in said housing and including an elongated tubular piston rod extending through said first partition in slidable fluid sealing relationship thereto, a piston connected to said piston rod and dividing said bore means into a first driving fluid chamber and a production fluid transfer chamber, passage means in said pump piston means for conducting production fluid to and from a delivery chamber, and one way valve means interposed in said passage means in such a way as to permit transfer of production fluid from said delivery chamber to said transfer chamber in response to said piston means being urged through a reciprocal stroke cycle in said housing; and valve means for admitting production fluid to said production fluid transfer chamber from said wellbore;

means in flow communication with said first driving fluid chamber for urging driving fluid to effect reciprocation of said piston means;

first conduit means extending between said pump and said wellhead and in fluid flow communication with said production fluid transfer chamber for conducting production fluid from said pump; and means for effecting displacement of production fluid in said first conduit means to cause said pump piston means to reciprocate to displace production fluid from said production fluid transfer chamber through said first conduit means to said wellhead.

11. The pump system set forth in claim 10 wherein:

said pump includes a lower head member defining in part said driving fluid chamber, and an elongated draft tube connected to said piston means and extending through said lower head member and including passage means for conducting production fluid from said wellbore to said passage means in said piston means.

12. The pump system set forth in claim 10 wherein:

said pump piston means includes a second piston connected to said piston rod at a point spaced from said first piston and defining a production fluid delivery chamber with said bore means and one way valve means interposed in said passage means in such a way as to permit transfer of production fluid to said delivery chamber and from said delivery chamber to said transfer chamber in response to said piston means being urged through a reciprocal stroke cycle in said housing.

13. The pump system set forth in claim 12 wherein:

said pump includes a head member of said housing forming with said second piston and said bore means a production fluid intake chamber, and one way valve means in said head member for admitting production fluid to said intake chamber from said wellbore.

14. The pump system set forth in claim 12 wherein:

said one way valve means includes a first one way valve disposed in said second piston and a second one way valve interposed in said passage means between said delivery chamber and said transfer chamber.

15. The pump system set forth in claim 14 wherein:

said piston rod includes passage means interconnecting said transfer chamber and said delivery chamber, said second one way valve being interposed in said passage means at an end of said piston rod adjacent said delivery chamber so as to minimize the residual volume of fluid which can expand in said delivery chamber during reciprocation of said piston means to expand the volume of said delivery chamber.

16. The pump system set forth in claim 15 wherein:

said housing includes spaced apart cylindrical housing members each coupled at one end, respectively, to opposed projections on said partition, a lower head member coupled to the opposite end of one of said housing members and an upper head member coupled to the opposite end of the other of said housing members, and said first partition includes a bore for receiving a fluid seal packing for sealing engagement with said piston rod.

17. The pump system set forth in claim 19 wherein:

said pistons include removable piston insert members defining with said pistons portions of said passage means, and at least one of said pistons includes a removable packing nut including a portion of said passage means and one of said one way valves.

18. A positive displacement downhole well pump for pumping production fluid from a well, said pump comprising an elongated pump housing, partition means interposed between opposed cylinder bore means formed in said pump housing, piston means disposed in said pump housing including an elongated tubular piston rod extending through said partition means in slidable fluid sealing relationship thereto, a first piston connected to said piston rod and dividing one of said bore means into a driving fluid chamber and a production fluid transfer chamber, means forming a port in said pump housing opening into said driving fluid chamber for communicating driving fluid to said driving fluid chamber, a second piston connected to said piston rod at a point spaced from said first piston and forming with the other of said bore means a production fluid delivery chamber, means for conducting production means to to said delivery chamber from the exterior of said pump housing, passage means in said piston means for conducting production fluid to and from said delivery chamber, one way valve means interposed in said passage means in such a way as to permit transfer of production fluid to said delivery chamber and from said delivery chamber to said transfer chamber in response to said piston means being urged through a reciprocal stroke cycle in said pump housing, and passage means in said pump housing for conducting production fluid from said transfer chamber to a production fluid conduit connected to said pump.

19. The pump set forth in claim 18 wherein:

said pump includes pressure responsive valve means in communication with said first conduit and the exterior of said pump housing for venting production fluid from said first conduit into said wellbore.

20. The pump set forth in claim 18 wherein:
said pump includes pressure responsive valve means in communication with said driving fluid chamber and said first conduit for charging said driving fluid chamber with pressure fluid through said passage means.

21. The pump set forth in claim 18 wherein:
said pump housing includes a first cylindrical tubular portion connected to said partition means and defining one of said bore means, and said pump housing includes an outer housing member disposed around said tubular portion and interconnecting said partition means with a head member of said pump, and driving fluid reservoir means formed in said pump between said tubular portion and said outer housing.

22. The pump set forth in claim 21 including:
a second tubular portion of said pump housing extending from said partition means to a lower head member and defining said delivery chamber.

23. The pump set forth in claim 18 wherein:
said one way valve means includes a first one way valve disposed in said second piston and a second one way valve interposed in said passage means between said first one way valve and said transfer chamber.

24. The pump set forth in claim 23 wherein:
said second piston includes a portion of said passage means and said second one way valve is disposed in said portion of said passage means in such a way as to minimize the volume of production fluid in said passage means between said first and second one way valves.

25. The pump set forth in claim 18 including:
means for connecting said pump at one end of said pump housing to said production fluid conduit, said connecting means including valve means for draining fluid from said production fluid conduit in response to lifting said pump upward from an operating position in a wellbore.

26. The pump set forth in claim 25 wherein:
said valve means for draining fluid comprises a coupling member including means for connecting said coupling member to said production fluid conduit, said coupling member including a closure member portion cooperable with a valve seat on said pump housing, and means for supporting said coupling member on said pump housing for limited axial movement between valve open and closed positions.

27. The pump set forth in claim 25 including:
means formed on said pump housing at the end of said pump opposite said one end for engagement with a cooperating member disposed on a driving fluid conduit for closing said driving fluid conduit to retain a standing column of driving fluid in said driving fluid conduit when said pump is disposed in said operating position.

28. The pump set forth in claim 18 wherein:
said driving fluid chamber is in communication with a gas charged accumulator for imposing a fluid biasing force on driving fluid in said driving fluid chamber, said accumulator being formed by a gas chamber defined by an accumulator housing connected to said pump housing.

29. The pump set forth in claim 28 wherein:
said accumulator housing is connected to the upper end of said pump housing when said pump is disposed in said wellbore.

30. The pump set forth in claim 29 wherein:
said passage means for conducting production fluid to said production fluid conduit is defined by a delivery conduit extending through said gas chamber.

* * * * *